US009675834B1

(12) United States Patent
Ellis

(10) Patent No.: US 9,675,834 B1
(45) Date of Patent: Jun. 13, 2017

(54) DYNAMIC MOTION EXERCISE MACHINE

(71) Applicant: Ellis I.P., Inc., Ocala, FL (US)

(72) Inventor: Joseph K. Ellis, Ocala, FL (US)

( * ) Notice: Subject to any disclaimer, the term of this patent is extended or adjusted under 35 U.S.C. 154(b) by 0 days.

(21) Appl. No.: 15/138,875

(22) Filed: Apr. 26, 2016

(51) Int. Cl.
*A63B 21/00* (2006.01)

(52) U.S. Cl.
CPC ..... *A63B 21/00185* (2013.01); *A63B 21/152* (2013.01); *A63B 21/4029* (2015.10); *A63B 21/4033* (2015.10); *A63B 21/4045* (2015.10)

(58) Field of Classification Search
CPC ..... A63B 21/00
USPC ..... 482/142, 130, 140, 95, 96
See application file for complete search history.

(56) References Cited

U.S. PATENT DOCUMENTS 4,300,760 A 11/1981 Bobroff
5,827,158 A 10/1998 Drecksel
5,971,901 A * 10/1999 Shaw ..... A61H 1/0218 482/142
6,168,557 B1 * 1/2001 Liao ..... A63B 21/0615 482/140
6,264,588 B1 7/2001 Ellis
6,287,241 B1 9/2001 Ellis
6,287,243 B1 * 9/2001 Isom ..... A63B 21/078 482/104
7,025,415 B1 * 4/2006 Wu ..... A47C 9/002 297/119
7,594,880 B2 9/2009 Webber
8,888,661 B2 11/2014 Ellis
2003/0022772 A1 * 1/2003 Stearns ..... A63B 21/0615 482/142
2014/0371036 A1 12/2014 Ellis

* cited by examiner

*Primary Examiner* — Jerome W Donnelly
(74) *Attorney, Agent, or Firm* — Laurence P. Colton; Smith Tempel Blaha LLC

(57) ABSTRACT

A series of improved exercise machines with a movable user engagement member operatively linked to a sliding while rotating user support such that when the user engagement member is engaged and activated by the user the user engagement member concurrently causes movement of the operative linkage system, which concurrently causes the user support to slide while rotating. This creates dynamic motion of the user support relative to the user engagement member.

28 Claims, 29 Drawing Sheets

DYNAMIC MOTION EXERCISE MACHINE

STATEMENT OF RELATED APPLICATIONS

None

BACKGROUND OF THE INVENTION

Technical Field

This invention relates to the general technical field of exercise, physical fitness and physical therapy equipment and machines. This invention relates more specifically to the field of strength conditioning exercise machines wherein a movable user engagement means is operatively linked to a sliding while rotating user support wherein urging of the user engagement means by the user causes the user support to slide and rotate during the exercise motion.

Prior Art

Exercise, physical fitness and physical therapy equipment and machines are available in various configurations and for various purposes, and are available for all of the major muscle groups. The majority of such equipment and machines, especially in the exercise field, concentrate either on cardiovascular conditioning or strength conditioning. Strength conditioning machines can be configured with a combination of several features. Those features are categorized as (a) the movement pattern of the user engagement or engagements, (b) whether or not the machine comprises a user support and if the machine comprises a user support the user support can be stationary or movable, and (c) the resistance to the motion of the user engagement that creates the exertion for the user.

The movement pattern of the user engagement can either be machine guided or user guided. Machine guided strength machines have a predetermined movement pattern where the user only has to apply the force to move the user engagement feature but does not have to control the movement pattern. User guided machines allow the user to control at least a portion of the movement pattern. Stationary user support machines keep the users center of mass stationary throughout the exercise motion. Movable user supports cause the users center of mass to move when the machine is being operated. The resistance to the user engagement feature can either be the user's body weight, or a secondary source of resistance such as gravity resisted weights or an alternative resistance source or a combination of the user's body weight and a secondary source of resistance.

The purpose of strength conditioning exercise machines is to improve the performance of a human motion or motions whether it be an athletic motion or simply a daily activity. For athletic motions and most daily activities, humans are in full body motion such that most or all of the human body is moving during any activity. Therefore, strength conditioning machines that move the user's entire body during the exercise motion more closely simulate real world activities and are therefore more effective and useful at increasing the performance of the human body for those activities.

This inventor has previously developed other machines that cause the user support to move during the exercise motion and operation of the machine. However, the current invention is another type of movable user support exercise motion that fills a need not previously met.

U.S. Pat. No. 6,264,588 discloses this inventor's development of a composite motion movement machine, which combines a moving actuating member and a moving user support, the composite motion movement machine having a user support member, a stationary main frame on which the user support is located, the user support member being pivotally connected to the main frame, a truck in slidable engagement with the user support member and the main frame, an actuating user engagement member being pivotally connected to the main frame and operatively connected to the truck, the actuating user engagement member being adapted to move between a first position and a second position, and a linking mechanism operatively connecting said actuating member with said truck, wherein, when the user moves the actuating member between the first position and the second position, the truck moves along rails on the user support member and the main frame, forcing the user support to pivot relative to the main frame such that the user is exercising against the resistance of at least portion of their body weight combined with at least a portion of the user support frame and any additional secondary resistance that may be added to movement of the user support. This motion is a fixed arcing motion of the user support and an improvement to stationary user support machines.

U.S. Pat. No. 8,888,661 discloses this inventor's improvement on abdominal and core exercise apparatuses by utilizing a centrally pivoting linkage member that is operatively attached on a first end to a pivoting upper body actuating member and operatively attached on an opposite second end to a sliding while pivoting user support. When the user pulls the upper body actuating member with their arms towards the user support and pulls the user support with their legs towards the upper body actuating member, this causes the first end of the centrally pivoting linkage member to move downward and causes the opposite second end of the centrally pivoting linkage member to move upward, thus causing the sliding while pivoting user support to move in a direction towards the pivoting upper body actuating member with the user support pivoting upwardly from back to front. This causes the user's upper and lower extremities to be in an extended position in the first position of the exercise and in a contracted position in the second position of the exercise, thus causing certain muscles of the user's abdominals and core portion of the torso to be exercised. This concurrent pulling motion of the user's upper and lower body creates an integration motion exercise with total body movement, whereas the current invention creates an isolation motion exercise with total body movement wherein a single muscle group is targeted on each embodiment.

U.S. Pat. No. 6,287,241 discloses this inventor's improvement on leg press exercise apparatuses by utilizing composite motion movement, which combines a moving actuating member and a moving user support, the machine having a user support member, a stationary main frame on which the user support is located, the user support member being pivotally connected to the main frame, a truck in slidable engagement with the user support member and the main frame, an actuating user engagement member for the user's feet being pivotally connected to the main frame and operatively connected to the truck, the actuating user engagement member being adapted to move between a first position and a second position, and a linking mechanism operatively connecting said actuating member with said truck, wherein, when the user moves the actuating member between the first position and the second position, the truck moves along rails on the user support member and the main frame, forcing the user support to pivot relative to the main frame such that the user is exercising against the resistance of at least portion of their body weight combined with at least a portion of the user support frame and any additional secondary resistance that may be added to movement of the user support. This motion is a fixed arcing motion of the user support and an improvement to stationary user support machines.

US Patent Publication No. 20140371036 discloses this inventor's development of a sliding while rotating user support exercise machine that comprises a three-bar tripod linkage system wherein one end of a first bar connects to the main frame, one end of a second bar connects to the traveling member, and one end of a third bar connects to the user support and the opposite end of all three bars converge to a floating central axle. The current invention improves upon this sliding while rotating multi-function exercise machine by creating greater rotation of the user support when the traveling member of each embodiment of the current invention travels the same distance as the traveling member of the multi-function exercise machine, thus creating a more dynamic motion that will more closely simulate real world activities. The current invention also addresses improving the sliding while rotating user support multi-function exercise machine by eliminating many components of the linkage system connecting the sliding while rotating user support to the stationary main frame, thus reducing costly components and reducing the number of wear parts.

Other exercise machines have been developed that have a movable user engagement means that is operatively linked to the user support. The deficiency of these machines are that they do not dynamically move the user's center of mass relative to the user engagement means during the exercise motion and thus are not as effective at simulating many everyday activities and natural body motions.

U.S. Pat. No. 7,594,880 of Webber shows a user support that pivots beneath and proximal to the user's center of mass and is operatively linked to a user engagement means. This stationary pivot motion creates minimal movement of the user's center of mass and therefore does not create dynamic movement of the user's hips relative to the movement of the user's hands or feet when activating the engagement means. This motion is inadequate to provide the dynamic motion required to simulate many athletic and daily activity movements.

U.S. Pat. No. 4,300,760 of Bobroff and U.S. Pat. No. 5,827,158 of Drecksel show various types of horse riding simulation machines where the user support is pivoted to the main frame of the machine and operatively connected to a pivoting pulling arm such that the two stationary pivots move in fixed arcs relative to the main frame during the exercise motion. While this creates total body movement, the stationary pivot of the user support does not provide the dynamic movement preferred by many users to simulate a variety of everyday activities.

BRIEF SUMMARY OF THE INVENTION

The present invention was developed to provide an improved exercise machine wherein a movable user engagement member is operatively linked to a movable user support that slides while rotating during the exercise motion such that the user's center of mass is dynamically moved relative to a movable user engagement member for simulating natural human motion.

Preferred embodiments of the invention comprise a stationary main frame having two parallel slide surfaces, a traveling member slidably connected to said slide surfaces for movement in fixed pattern, a pivoting user support connected at a lower first pivot to the traveling member and connected at an upper second pivot to a rigid lifting member, a rigid elongated lifting member with a first end and a second end, a user engagement member moveably connected to the main frame or the user support and operatively linked to the traveling member and or the lifting member, with the first end of the lifting member being pivotally connected to the stationary main frame and the second end of the lifting member being pivotally connected to the upper second pivot of the user support such that the intersecting pivotal location of the second end of the lifting member and second upper pivotal connection of the user support is located above a linear plane with end points located at the first end of the lifting member and the first lower pivotal connection of the user support and the intersecting pivotal location of the second end of the lifting member, and the second upper pivotal connection of the user support remains above a linear plane with end points located at the first end of the lifting member and the first lower pivotal connection of the user support throughout the exercise motion, wherein movement of the user engagement member causes concurrent movement of the traveling member, lifting arm, and user support such that the user support slides while rotating.

The invention can be presented in various embodiments for exercising various portions of the user's body with the common feature of all the embodiments being that the user's center of mass moves dynamically in relationship to the user engagement member such that movement of the user engagement member causes the user support to concurrently slide and pivot. Machines that only pivot the user support cannot create enough movement of user's center of mass to simulate the way the human body would naturally position itself to gain optimal leverage against a resistance force. Also, machines that do not operatively link a movable user engagement member to a movable user support cannot create the constant realignment of the user support and user engagement member necessary to create the natural human positioning of various portions of the user's body during an exercise motion. Certain embodiments of the present invention create dynamic movement of the user's hips relative to the user's feet and in other embodiments create dynamic movement of the user's hips relative to the user's hands. In certain embodiments to create the correct biomechanical exercise motion the user engagement member is mounted on the movable user support. In other embodiments to create the correct biomechanical exercise motion the user engagement member is mounted on the stationary main frame. In certain embodiments to create the correct biomechanical exercise motion the user engagement member is a pivoting member. In certain embodiments the user engagement member is a rigid one-piece member. In other embodiments the user engagement member consists of multiple rigid members. In certain embodiments there are two separate and independent user engagement members for the user's hands that may move in a converging and diverging movement pattern. In certain embodiments the user engagement member consists of two independent hand grip brackets attached to a flexible linkage component that allow the user to define the movement pattern of the user's hands.

In preferred embodiments the traveling member can either slide on any low friction surface or roll on wheels or linear bears or the like.

In all preferred embodiments of the invention the traveling member slides or rolls when urged by the operative linkage to the user engagement member. This operative linkage can consist of various configurations and be assembled from single or multiple components to meet the requirements of the exercise and to accommodate users of all ability levels. For example, certain embodiments may require the user engagement member to have a mechanical advantage such that the force required to move the traveling member is reduced. These mechanical advantage components may include one or more of the following: cams, pulleys, levers, wheels, linear bearings, pivot axles, and flexible members such as a cable. Some configurations of the operative linkage may consist of one or more flexible components such as cables, other configurations may consist of one or more rigid components, still other configurations may include one or more slidable components, and even other configurations may consist of a combination of a combination of one or more flexible components, rigid components, and or slidable components. In certain embodiments the operative linkage may connect to the traveling member, in other embodiments the operative linkage may connect to the lifting member, and in still other embodiments the operative linkage may connect to both the traveling member and lifting member.

In all preferred embodiments of the invention various components of the machine can be adjustable to accommodate the needs of the user. These adjustments can include the distance and or angle of the user engagement member relative to the entirety of the user support or a portion of the user support.

Additional resistance may be added to the exercise motion of each embodiment of the invention. The resistance may consist of various components such as weight stacks, free weight discs, hydraulics, pneumatics, moment arms, flexible rods, electromagnetic resistance, or alternative resistance components and assemblies. These resistance components may be operatively linked to one or more of the moving components of any embodiment of the invention or directly mounted on one or more of the moving component of any embodiment of the invention.

These features, and other features and advantages of the present invention, will become more apparent to those of ordinary skill in the art when the following detailed description of the preferred embodiments is read in conjunction with the appended figures in which like reference numerals designate like elements throughout the several views.

BRIEF DESCRIPTION OF THE DRAWINGS

The figures illustrate each embodiment from multiple angle views to best illustrate the features and functions of each embodiment. Some of the figures illustrate a user mounted on the machine for clarity of the exercise motion.

DETAILED DESCRIPTION OF PREFERRED EMBODIMENTS

Figure 1:
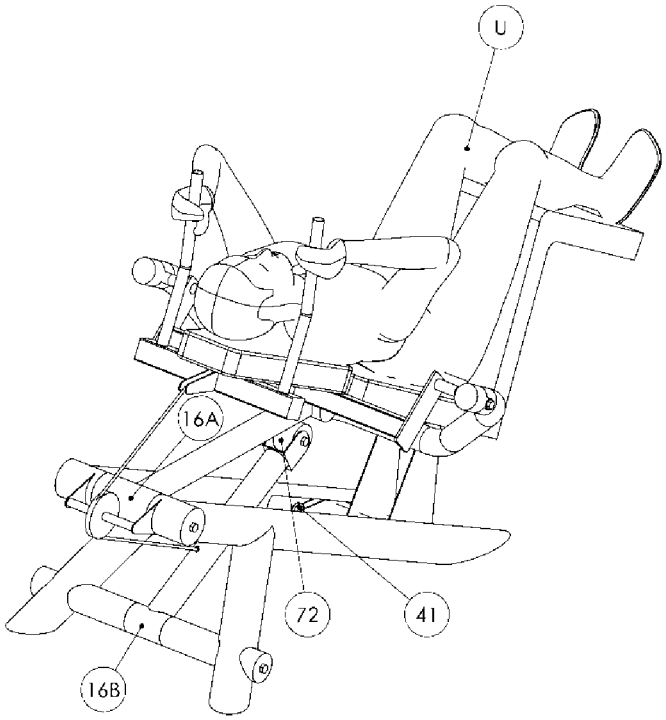
FIG. 1 is a perspective view of an embodiment of the invention in the at rest and unactivated position illustrating a user mounted on a machine that exercises a user's abdominal muscles wherein the operative linkage connecting the user engagement member and the lifting member is configured as a combination of a cable, pulley, pivoting lever and wheel. Additional resistance can be added to this embodiment, but is not shown in this view to more clearly illustrate the components.
Figure 2:
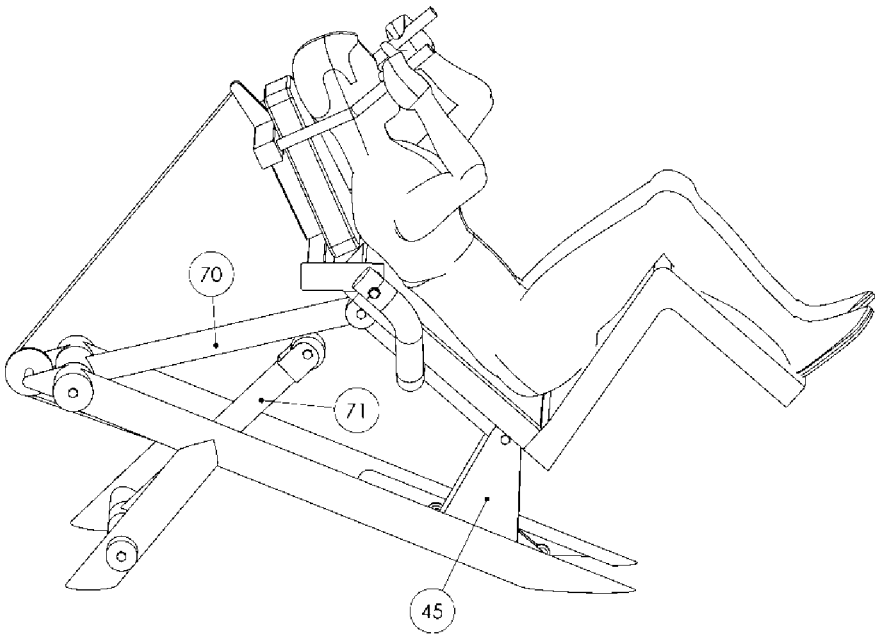
FIG. 2 is a perspective view of an embodiment of the invention in the engaged and activated position illustrating a user mounted on a machine that exercises the user's abdominal muscles wherein the operative linkage connecting the user engagement member and the lifting member is configured as a combination of a cable, pulley, pivoting lever, and wheel. Additional resistance can be added to this embodiment, but is not shown in this view to more clearly illustrate the components.
Figure 3:
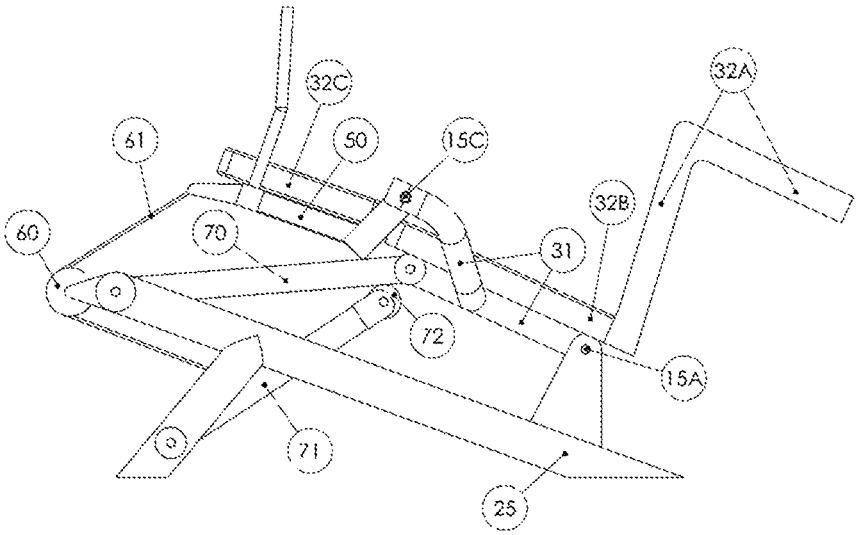
FIG. 3 is a side view of an embodiment of the invention in the at rest and unactivated position illustrating a machine that exercises a user's abdominal muscles wherein the operative linkage connecting the user engagement member and the lifting member is configured as a combination of a cable, pulley, pivoting lever, and wheel. Additional resistance can be added to this embodiment, but is not shown in this view to more clearly illustrate the components.
Figure 4:
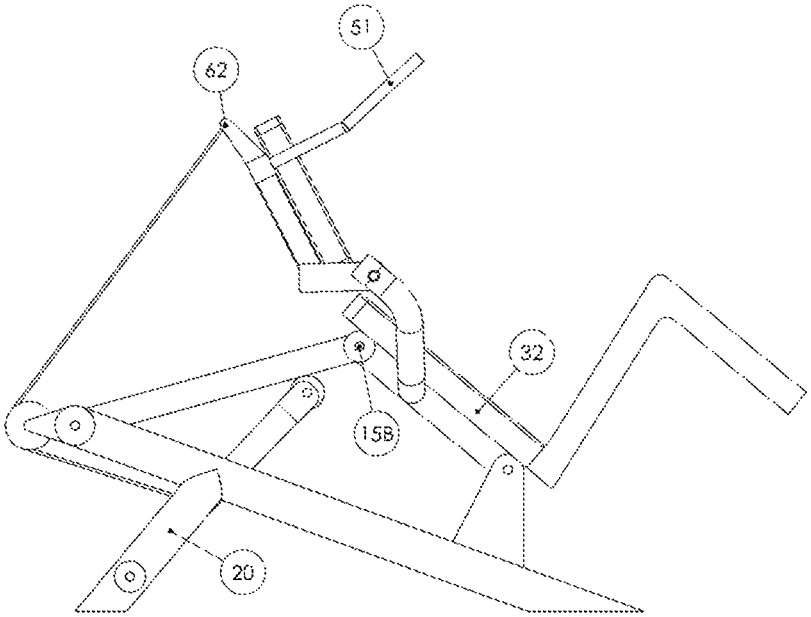
FIG. 4 is a side view of an embodiment of the invention in the engaged and activated position illustrating a machine that exercises the user's abdominal muscles wherein the operative linkage connecting the user engagement member and the lifting member is configured as a combination of a cable, pulley, pivoting lever, and wheel. Additional resistance can be added to this embodiment, but is not shown in this view to more clearly illustrate the components.
Figure 5:
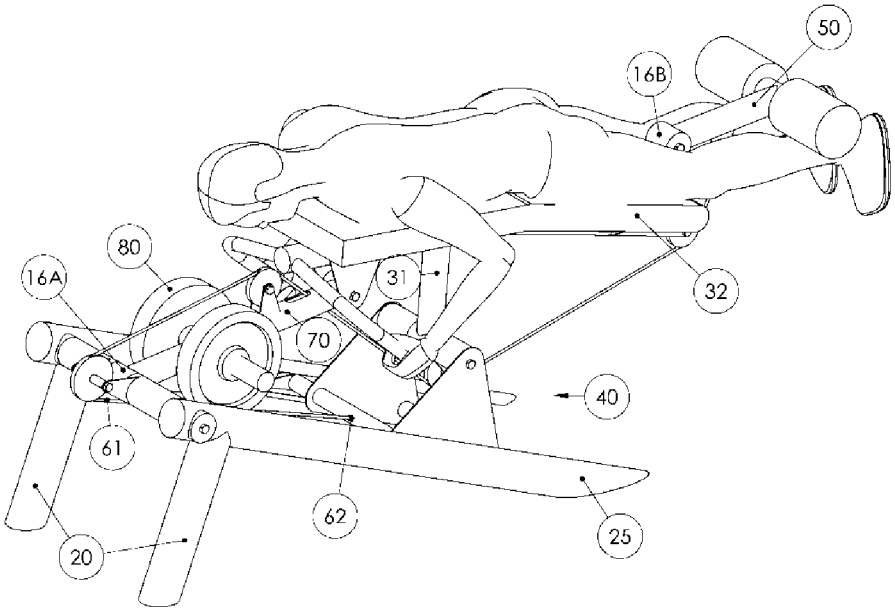
FIG. 5 is a perspective view of an embodiment of the invention in the at rest and unactivated position illustrating a user mounted on a machine that exercises a user's hamstring muscles wherein the operative linkage connecting the user engagement member to the lift member and the traveling member is configured as a combination of a cable and a plurality of pulleys. Additional resistance to the exercise motion is provided by removable weight discs that are loaded onto receivers mounted on the lifting member.
Figure 6:
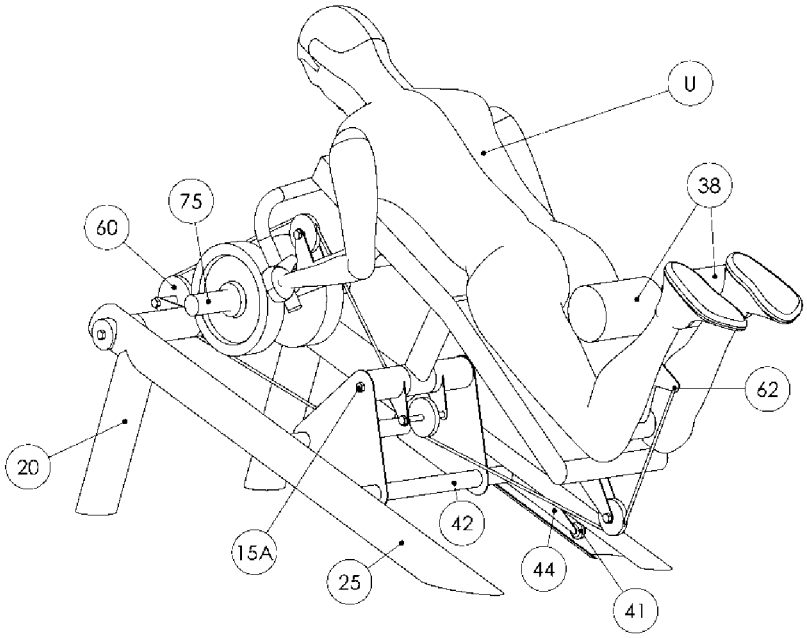
FIG. 6 is a perspective view of an embodiment of the invention in the engaged and activated position illustrating a user mounted on a machine that exercises a user's hamstring muscles wherein the operative linkage connecting the user engagement member to the lifting member and the traveling member is configured as a combination of a cable and a plurality of pulleys. Additional resistance to the exercise motion is provided by removable weight discs that are loaded onto receivers mounted on the lifting member.
Figure 7:
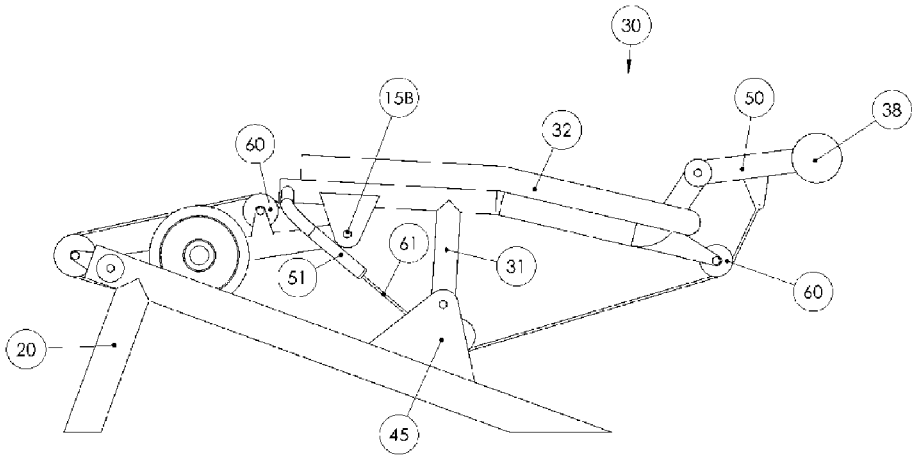
FIG. 7 is a side view of an embodiment of the invention in the at rest and unactivated position illustrating a machine that exercises a user's hamstring muscles wherein the operative linkage connecting the user engagement member to the lifting member and the traveling member is configured as a combination of a cable and a plurality of pulleys. Additional resistance to the exercise motion is provided by removable weight discs that are loaded onto receivers mounted on the lifting member.
Figure 8:
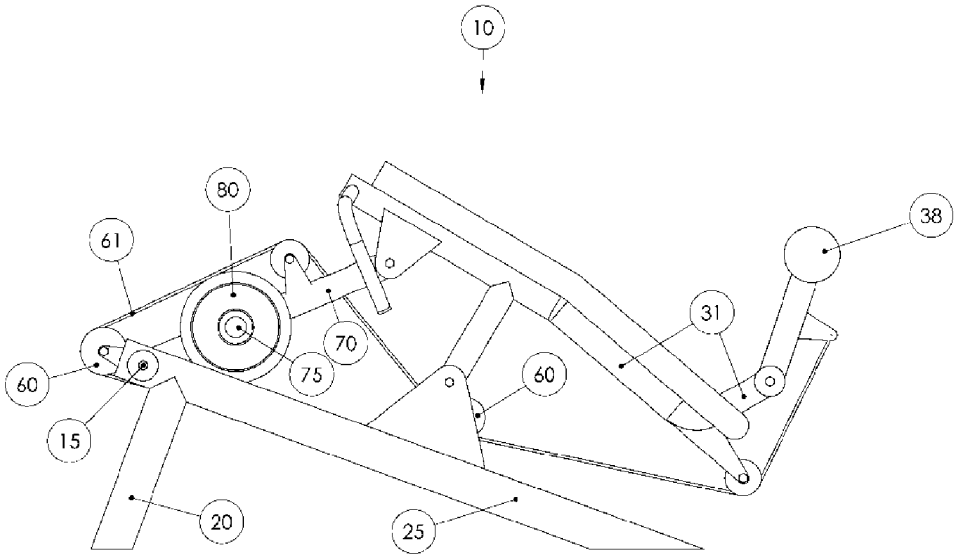
FIG. 8 is a side view of an embodiment of the invention in the engaged and activated position illustrating a machine that exercises a user's hamstring muscles wherein the operative linkage connecting the user engagement member to the lifting member and the traveling member is configured as a combination of a cable and a plurality of pulleys. Additional resistance to the exercise motion is provided by removable weight discs that are loaded onto receivers mounted on the lifting member.
Figure 9:
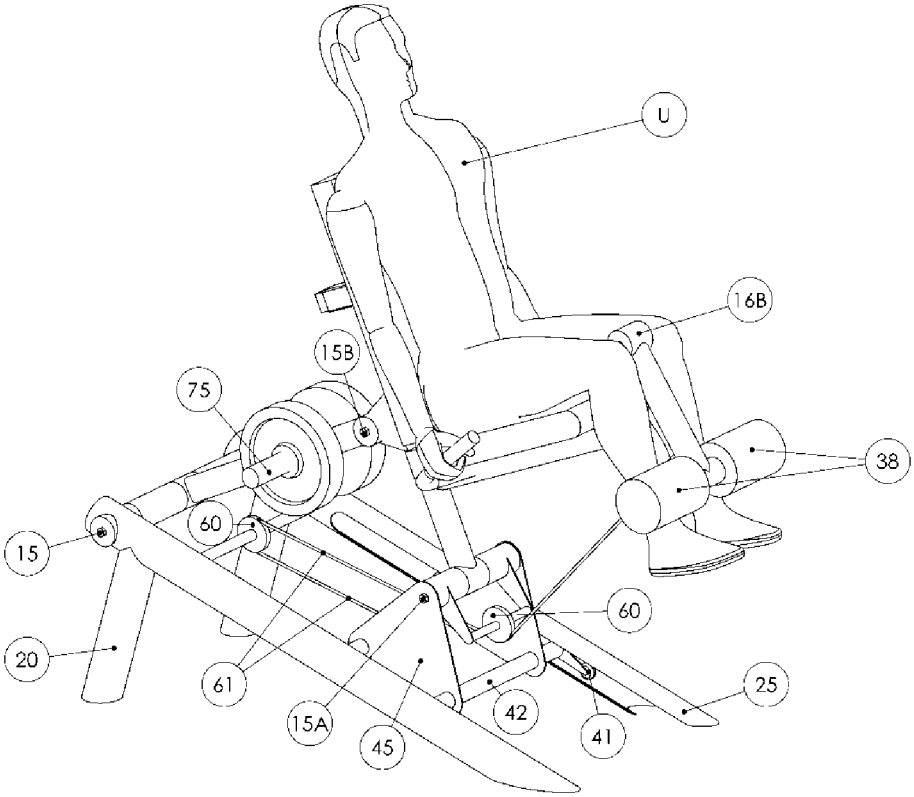
FIG. 9 is a perspective view of an embodiment of the invention in the at rest and unactivated position illustrating a user mounted on a machine that exercises a user's quadriceps muscles wherein the operative linkage connecting the user engagement member and the traveling member is configured as a combination of a cable and a plurality of pulleys. Additional resistance to the exercise motion is provided by removable weight discs that are loaded onto receivers mounted on the lifting member.
Figure 10:
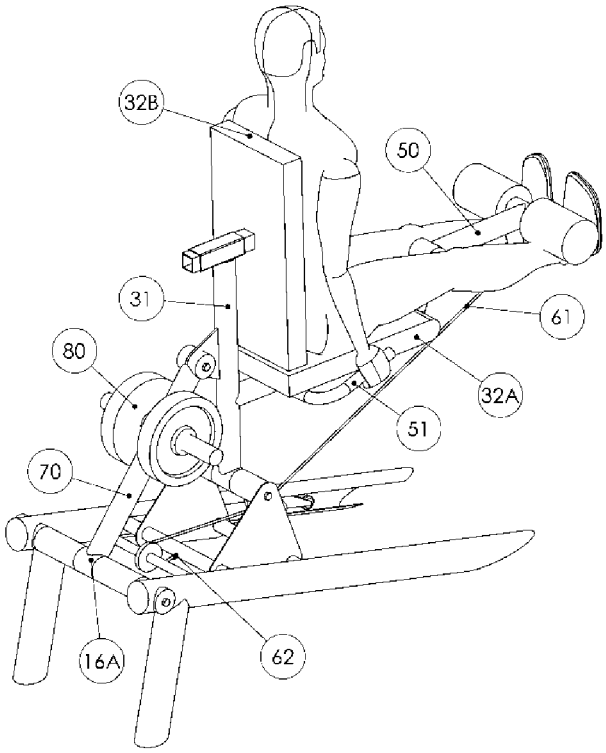
FIG. 10 is a perspective view of an embodiment of the invention in the engaged and activated position illustrating a user mounted on a machine that exercises a user's quadriceps muscles wherein the operative linkage connecting the user engagement member and the traveling member is configured as a combination of a cable and a plurality of pulleys. Additional resistance to the exercise motion is provided by removable weight discs that are loaded onto receivers mounted on the lifting member.
Figure 11:
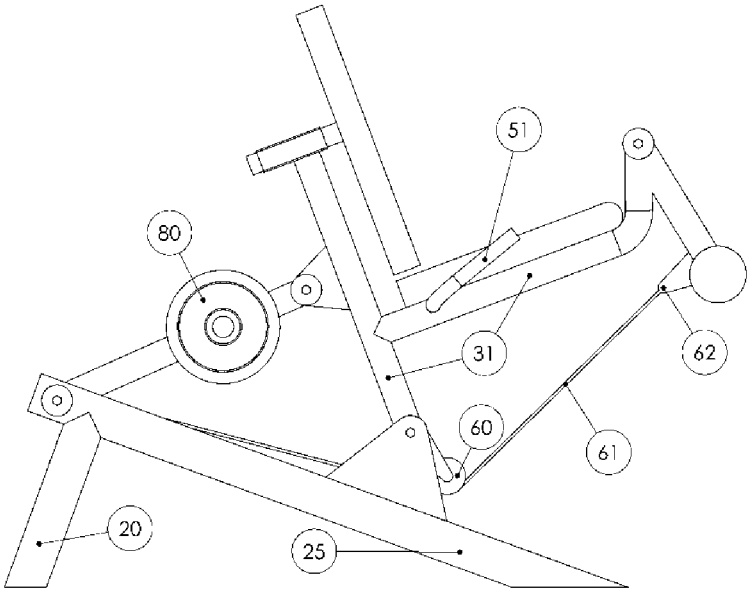
FIG. 11 is a side view of an embodiment of the invention in the at rest and unactivated position illustrating a machine that exercises a user's quadriceps muscles wherein the operative linkage connecting the user engagement member and the traveling member is configured as a combination of a cable and a plurality of pulleys. Additional resistance to the exercise motion is provided by removable weight discs that are loaded onto receivers mounted on the lifting member.
Figure 12:
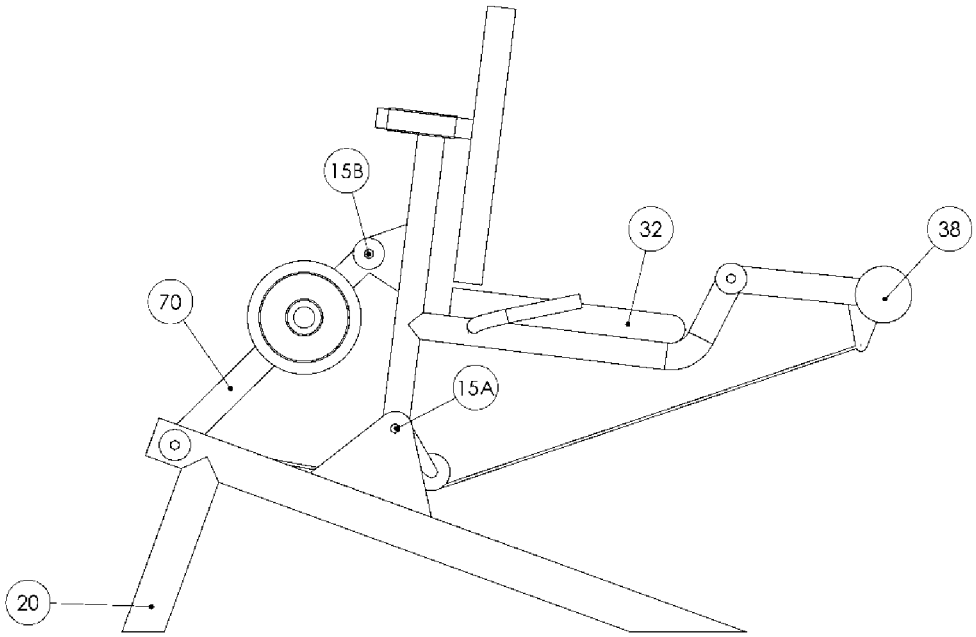
FIG. 12 is a side view of an embodiment of the invention in the engaged and activated position illustrating a machine that exercises a user's quadriceps muscles wherein the operative linkage connecting the user engagement member and the traveling member is configured as a combination of a cable and a plurality of pulleys. Additional resistance to the exercise motion is provided by removable weight discs that are loaded onto receivers mounted on the lifting member.
Figure 13:
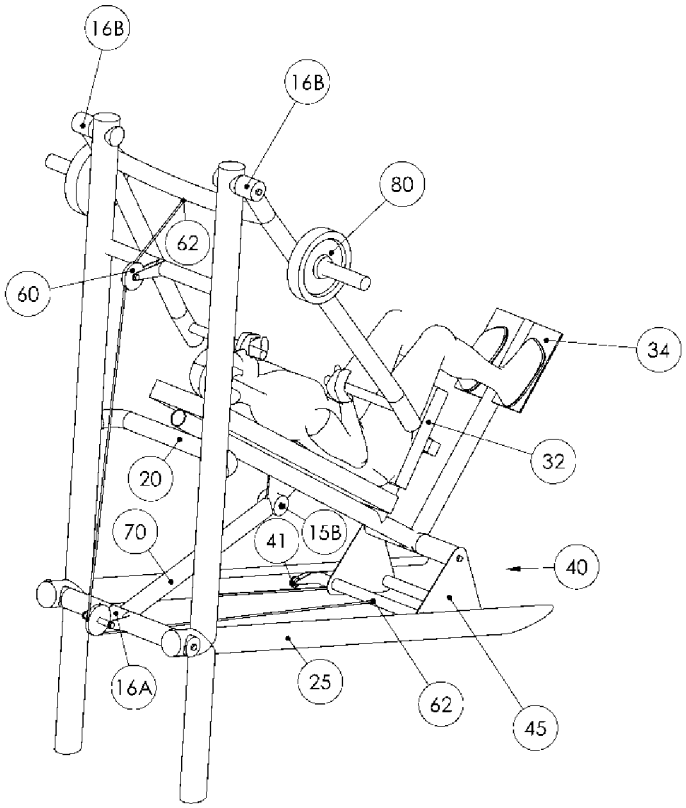
FIG. 13 is a perspective view of an embodiment of the invention in the at rest and unactivated position illustrating a user mounted on a machine that exercises a user's pectoral muscles wherein the operative linkage connecting the user engagement member and the traveling member is configured as a combination of a cable and a plurality of pulleys. Additional resistance to the exercise motion is provided by removable weight discs that are loaded onto receivers mounted on the user engagement member.
Figure 14:
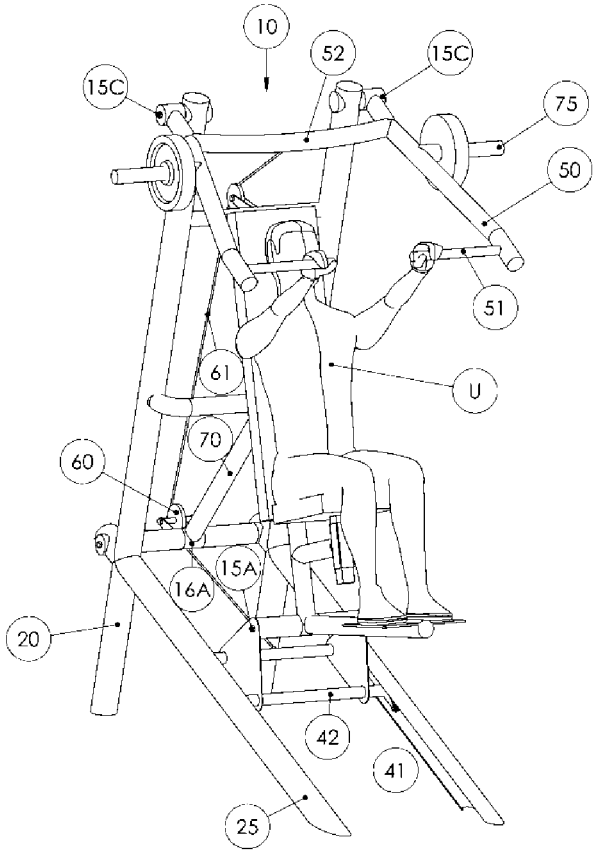
FIG. 14 is a perspective view of an embodiment of the invention in the engaged and activated position illustrating a user mounted on a machine that exercises a user's pectoral muscles wherein the operative linkage connecting the user engagement member and the traveling member is configured as a combination of a cable and a plurality of pulleys. Additional resistance to the exercise motion is provided by removable weight discs that are loaded onto receivers mounted on the user engagement member.
Figure 15:
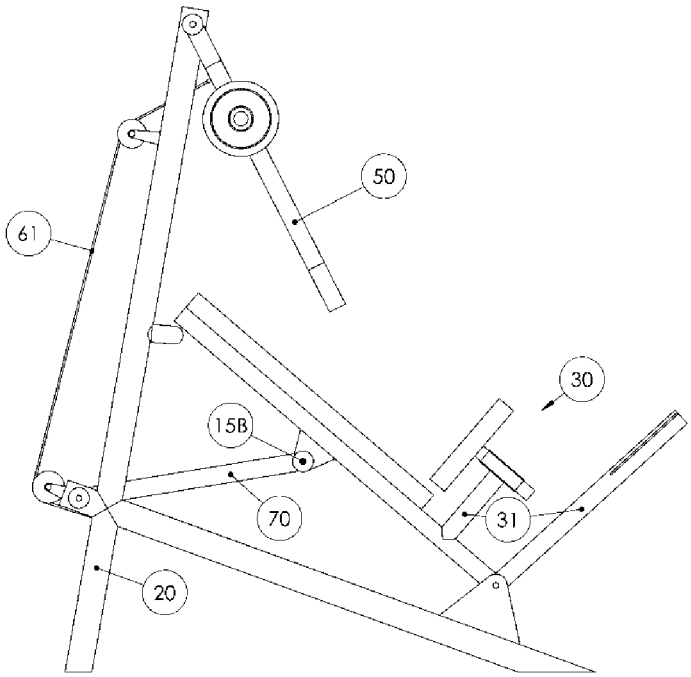
FIG. 15 is a side view of an embodiment of the invention in the at rest and unactivated position illustrating a machine that exercises a user's pectoral muscles wherein the operative linkage connecting the user engagement member and the traveling member is configured as a combination of a cable and a plurality of pulleys. Additional resistance to the exercise motion is provided by removable weight discs that are loaded onto receivers mounted on the user engagement member.
Figure 16:
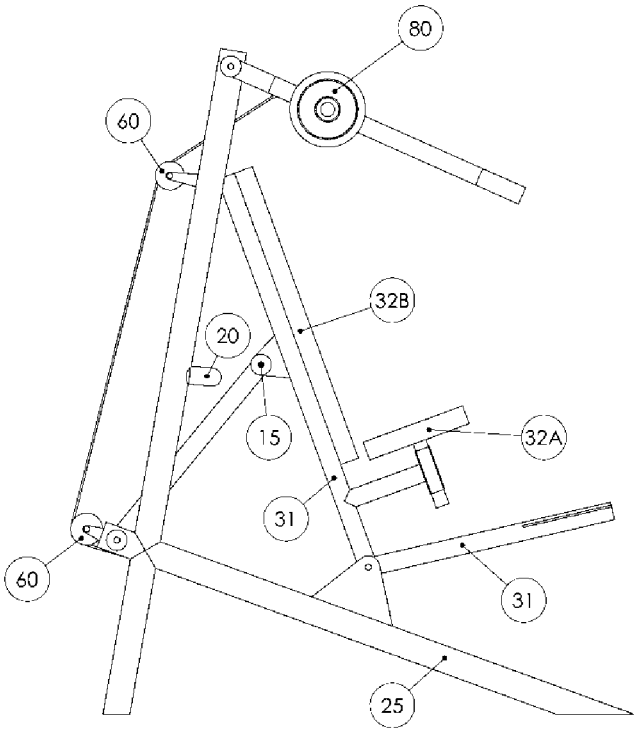
FIG. 16 is a side view of an embodiment of the invention in the engaged and activated position illustrating a machine that exercises a user's pectoral muscles wherein the operative linkage connecting the user engagement member and the traveling member is configured as a combination of a cable and a plurality of pulleys. Additional resistance to the exercise motion is provided by removable weight discs that are loaded onto receivers mounted on the user engagement member.
Figure 17:
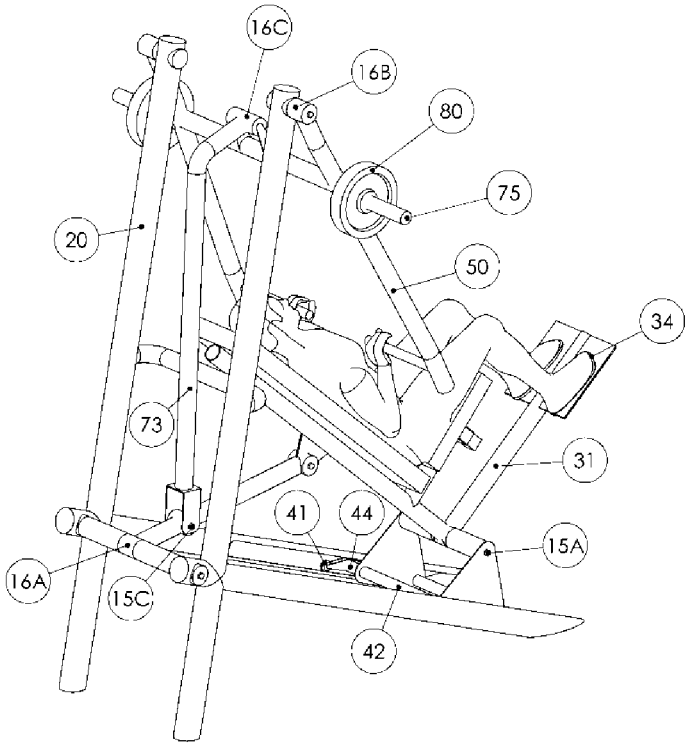
FIG. 17 is a perspective view of an embodiment of the invention in the at rest and unactivated position illustrating a user mounted on a machine that exercises a user's pectoral muscles wherein the operative linkage connecting the user engagement member and the lifting member is configured as a rigid bar that pivots on each end. Additional resistance to the exercise motion is provided by removable weight discs that are loaded onto receivers mounted on the user engagement member.
Figure 18:
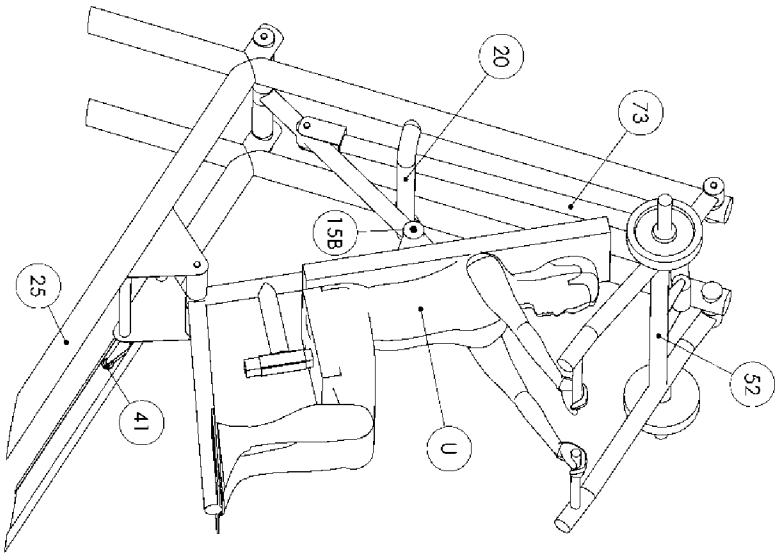
FIG. 18 is a perspective view of an embodiment of the invention in the engaged and activated position illustrating a user mounted on a machine that exercises a user's pectoral muscles wherein the operative linkage connecting the user engagement member and the lifting member is configured as a rigid bar that pivots on each end. Additional resistance to the exercise motion is provided by removable weight discs that are loaded onto receivers mounted on the user engagement member.
Figure 19:
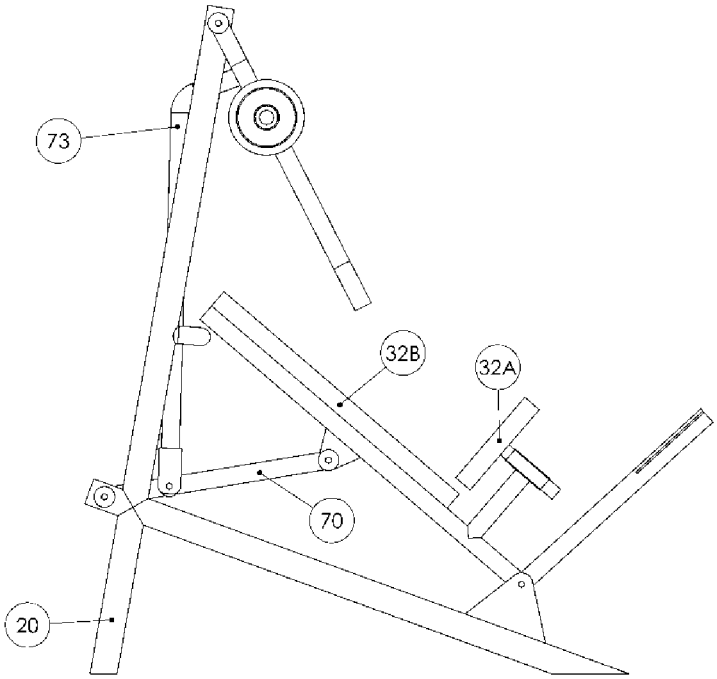
FIG. 19 is a side view of an embodiment of the invention in the at rest and unactivated position illustrating a machine that exercises a user's pectoral muscles wherein the operative linkage connecting the user engagement member and the lifting member is configured as a rigid bar that pivots on each end. Additional resistance to the exercise motion is provided by removable weight discs that are loaded onto receivers mounted on the user engagement member.
Figure 20:
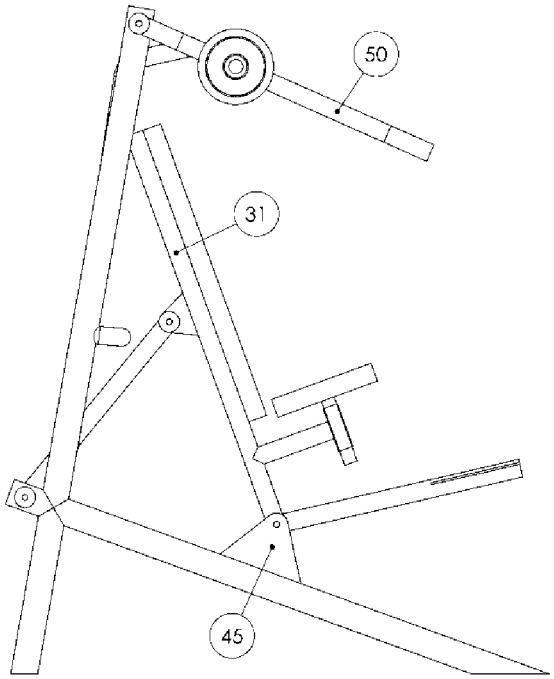
FIG. 20 is a side view of an embodiment of the invention in the engaged and activated position illustrating a machine that exercises a user's pectoral muscles wherein the operative linkage connecting the user engagement member and the lifting member is configured as a rigid bar that pivots on each end. Additional resistance to the exercise motion is provided by removable weight discs that are loaded onto receivers mounted on the user engagement member.

Exemplary preferred embodiments are disclosed below in connection with the attached drawings. Throughout this specification and disclosure, various terms will be used to describe various elements or sets of elements, features or sets of features, and devices or sets of devices. For example, the term rearward end or portion of the machine would refer to the end or portion of the machine most proximal to the lower pivot of the lifting member. The term forward end or portion of the machine would refer to the end or portion of the machine most distal to the lower pivot of the lifting member. The term user support or movable user support will be used to describe any pad, bar, platform, or other elements that supports the user during operation of the machine. The terms at rest, unactivated, and starting positions will be used to describe when the user is not engaging the device, or only minimally so. The terms activated, extended, engaged, and operating will be used to describe when the user is in motion performing an exercise on the machine. The term releasing or releases will be used to describe the user's action during operation of the machine when the user is reducing or lessening their exertion force upon the user engagement member or members. The terms push, pushing, press, pressing, pull, or pulling when referring to the user operating the machine will be used to describe any motion or movement by a user when they are maintaining or increasing their exertion force. The term upper body will refer generally to the user's arms and hands but may also refer to the user's chest, back, and torso as well. The term lower body will generally refer to the user's legs and feet but may also refer to the user's buttocks and hips as well. The term user engagement member will refer to any movable handles, platforms, pads, or other user engagement means engaged by any portion of the user's body to exert force upon an operative component of the machine during the exercise motion.

FIGS. 1-29 are all views of embodiments of the invention this inventor terms a Dynamic Motion Exercise Machine. Generally, the invention is a machine that dynamically moves the user's center of mass during an exercise motion whereby movement of a user engagement member causes the user support to dynamically slide while rotating. The user engagement member, the lifting member, and the traveling member can be operatively linked in various configurations. In all preferred embodiments of the invention any movement of the user engagement member will cause concurrent movement of the traveling member, lifting member, and user support. All preferred embodiments of the invention may be configured such that additional resistance can be added to the exercise motion.

Referring now to FIGS. 1-27, various views of multiple embodiments of machine 10 are shown to provide a more complete understanding of the invention. In all preferred embodiments machine 10 comprises stationary main frame 20, slide surfaces 25, a movable user support assembly 30, traveling member assembly 40, lifting member 70, and user engagement member 50. In certain embodiments user engagement member 50 and traveling member assembly 40 are operatively linked. In certain embodiments user engagement member 50 and lifting member 70 are operatively linked. In certain embodiments user engagement member 50 and lifting member 70 and traveling member assembly 40 are operatively linked. Machine 10 can be constructed of any suitable material, such as formed tubes or channels, made from steel or other metals or suitable materials, for supporting the working components of machine 10. Slide surfaces 25 and main frame 20 comprise components such as tubes and stands so as to form a stable base adequate to stably support the remainder of machine 10 and a user U, as well as being able to stably withstand the movement of machine 10 during use.

Figure 27:
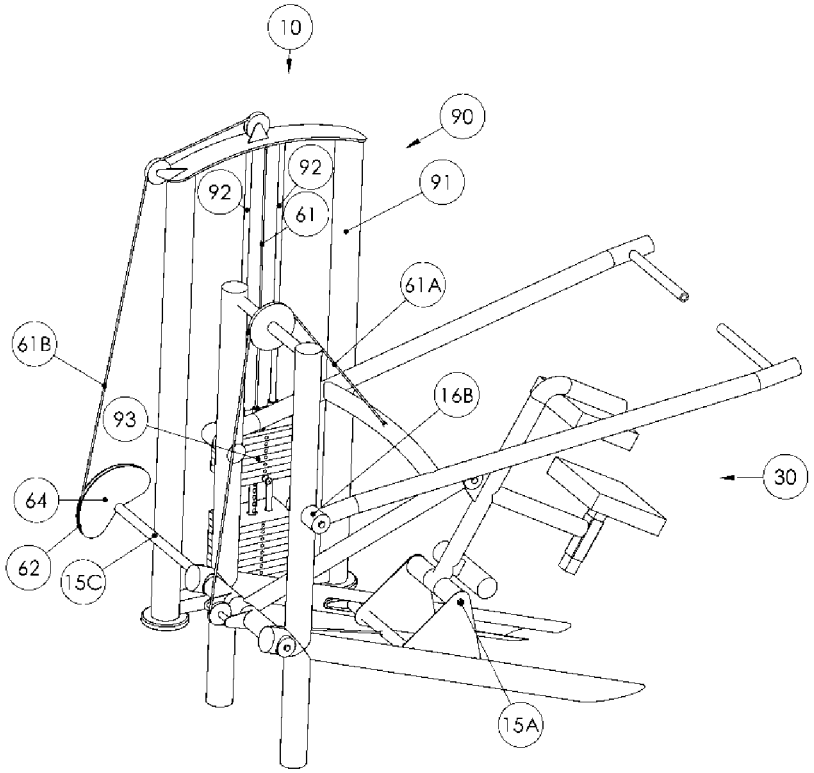
FIG. 27 is a perspective view of an embodiment of the invention in the engaged and activated position illustrating a machine that exercises a user's latissimus dorsi muscles wherein the operative linkage connecting the user engagement member and the traveling member is configured as a combination of a cable and a plurality of pulleys. Additional resistance to the exercise motion is provided by a weight stack system that is operatively linked to the lifting member axle.
Figure 28:
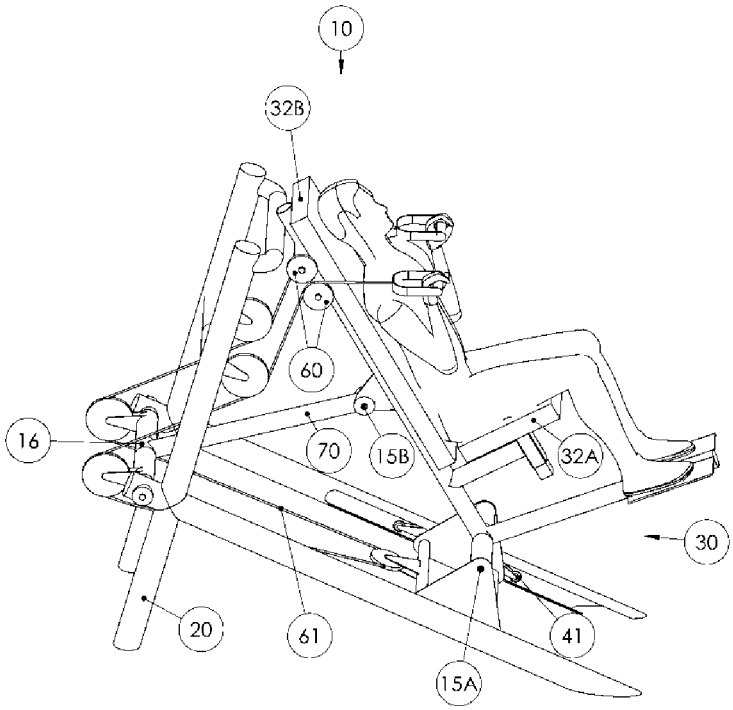
FIG. 28 is a perspective view of an embodiment of the invention in the at rest and unactivated position illustrating a user mounted on a machine that can exercise various muscle groups of the user's upper body wherein the user controls the movement pattern of a pair of user engagement member cable handles and the operative linkage connecting the user engagement member and the traveling member is a configured as a combination of a cable and a plurality of pulleys. Additional resistance can be added to this embodiment, but is not shown in this view to more clearly illustrate the components.
Figure 29:
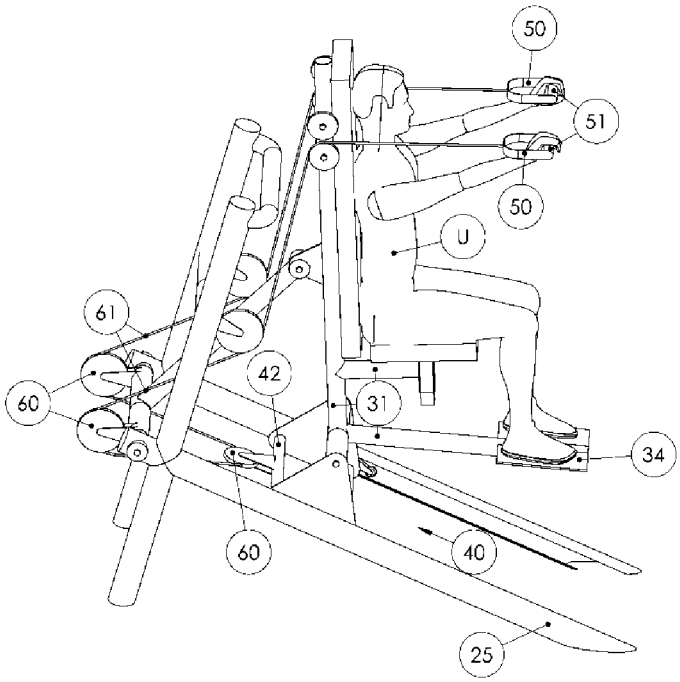
FIG. 29 is a perspective view of an embodiment of the invention in an engaged and activated position illustrating a user mounted on a machine that can exercise various muscle groups of the user's upper body wherein the user controls the movement pattern of a set of user engagement member cable handles and the operative linkage connecting the user engagement member and the traveling member is a configured as a combination of a cable and a plurality of pulleys. Additional resistance can be added to this embodiment, but is not shown in this view to more clearly illustrate the components.

In all preferred embodiments of the invention user support 30 is rotatably mounted on traveling member assembly 40, traveling member assembly 40 is slidably engaged with stationary slide surfaces 25, and slide surfaces 25 are rigidly connected to main frame 20 such that slide surfaces 25 and main frame 20 form one rigid support structure for machine 10. In certain embodiments as illustrated in FIGS. 13-27, user engagement actuator 50 is a mostly rigid member pivotally mounted on main frame 20. In certain embodiments, such as illustrated in FIGS. 1-12, user engagement member 50 is a rigid member that is pivotally mounted on user support 30. In certain embodiments, such as illustrated in FIGS. 28 and 29, user engagement member 50 consists of two individual brackets connected to individual ends of a flexible component such as a cable that is operatively connected to traveling member assembly 40.

In all preferred embodiments of the invention lifting member 70 is pivotally mounted at a first lower end on main frame 20 and pivotally connected at a second higher end to user support frame 31.

In all preferred embodiments user engagement member 50 is operatively linked to movement of traveling member assembly 40, lifting member 70, and user support 30. In certain embodiments, such as illustrated in FIGS. 5-16 and 21-29, user engagement member 50 is linked to traveling member assembly 40 via linkage cable 61 and linkage cable pulleys 60. In certain embodiments, such as illustrated in FIGS. 1-4, user engagement member 50 is linked to lifting member 70 via linkage cable 61, linkage cable pulley 60, pivoting linkage lever 71, and pivoting linkage lever wheel 72. In certain embodiments, such as illustrated in FIGS.

17-20, user engagement member 50 is linked to lifting member 70 via linkage bar 73.

Figure 26:
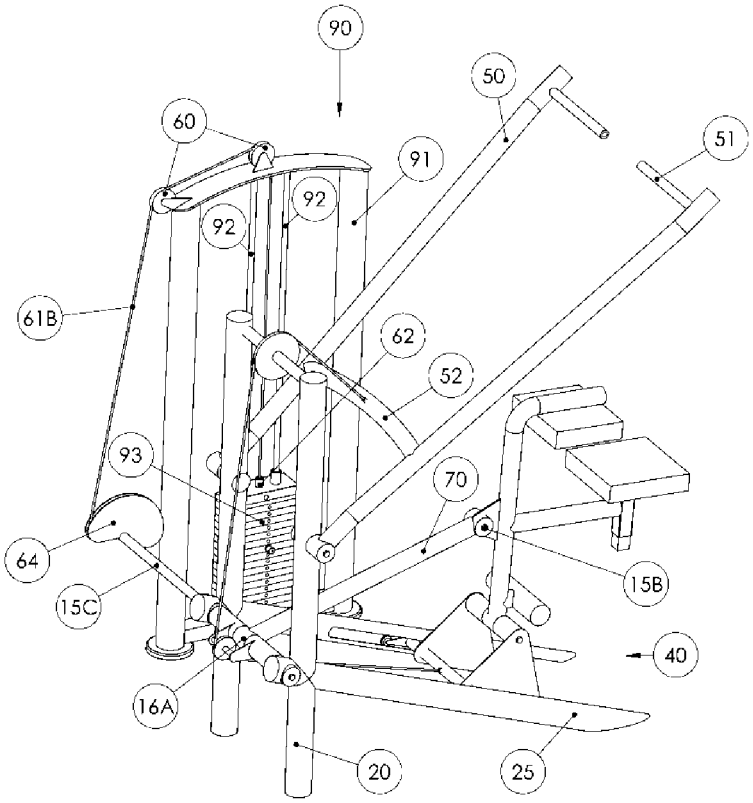
FIG. 26 is a perspective view of an embodiment of the invention in the at rest and unactivated position illustrating a machine that exercises a user's latissimus dorsi muscles wherein the operative linkage connecting the user engagement member and the traveling member is configured as a combination of a cable and a plurality of pulleys. Additional resistance to the exercise motion is provided by a weight stack system that is operatively linked to the lifting member axle.

In all preferred embodiments of the invention additional resistance can be added to movement of user engagement member 50. In certain embodiments, such as illustrated in FIGS. 5-25, the additional resistance consists of removable weight disc 80 that are placed onto weight disc receiver 75 by user U prior to operation of machine 10. In certain embodiments, such as illustrated in FIGS. 26 and 27, the additional resistance consists of a weight stack 93 that is operatively linked to user engagement member 50 via pivot axle 15, linkage cable cam 64, linkage cable 61, and linkage cable pulleys 60.

User support assembly 30 can be configured into multiple configurations and of multiple components that will support and position user U in various positions such as seated, reclined, prone, supine, or other positions suitable to the exercise motion of each embodiment of the invention. User support frame 31 components are generally rigid components that support one or more user support pads 32 and in certain embodiments, such as illustrated in FIGS. 21-27, user hold down pads 33, and in certain embodiments, such as illustrated in FIGS. 13-29, user foot support 34. User support pads 32 may be of various shapes and sizes to comfortably support various body parts of the user U. In most embodiments one or more of the components of user support 30 may be adjustable by user U prior to operation of machine 10 to comfortably support and properly position user U during operation of machine 10.

In all preferred embodiments of the invention traveling member assembly 40 has a pivotal connection to user support 30 and a slidable or rollable connection to slide surface 25. The components of traveling member assembly 40 as are illustrated in detail in FIG. 25 consist of traveling member frame 45, traveling member cross braces 42, traveling member wheel connection brackets 44, and traveling member wheels 41. Traveling member frames 45 are illustrated as rigid triangular components but may be of any suitable shape capable of housing a pivot connection to user support 30 and a connection to the traveling member wheels or slide components. Traveling member frame cross braces 42 are components that provided structural integrity to traveling member assembly 40 and connect traveling member frame 45 with traveling member wheel connection bracket 44. Traveling member wheels 41 are connected to traveling member assembly 40 via traveling member wheel connection brackets 44 such that traveling member wheels 41 support and move traveling member assembly 40. Traveling member wheels 41 are rollably engaged with frame 20 via slide surface 25. Traveling member assembly 40 is illustrated in each embodiment of the invention as rolling on traveling member wheels 41; however, traveling member assembly 40 may slide or roll via any suitable low friction component capable of adequately supporting traveling member assembly 40 and user support 30 and user U during operation of machine 10.

Slide surface 25 is illustrated in each embodiment as an elongated concave surface that supports and guides traveling member wheels 41; however, slide surface 25 may consist of any suitable surface capable of guiding and supporting a low friction sliding or rolling component of traveling member assembly 40 during operation of machine 10.

In each preferred embodiment of the invention user engagement actuator 50 has an attached receiver for either the user's upper body, such as grip handles 51, or the user's lower body, such as leg pads 38. In certain embodiments, such as illustrated in FIGS. 1-27, user engagement member 50 is a generally rigid pivoting member. In certain embodiments, such as illustrated in FIGS. 28 and 29, user engagement members 50 consist of two independent mostly identical free moving brackets that each house a grip handle 51 and directly attach to linkage cable 61.

In each preferred embodiment of the invention lifting member 70 is a rigid elongated member capable of pivoting on each end and capable of lifting at least a portion of user support 30 while rotating user support 30 and user U during operation of machine 10.

In certain embodiments of the invention, such as illustrated in FIGS. 28 and 29, weight stack assembly 90 is operatively linked to the movement of user engagement member 50 so as to provide additional resistance to the exercise motion during operation of machine 10. Weight stack assembly 90 consists of weight stack frame 91, weight stack guide rods 92, and weight stack 93. Weight stack frame 91 is generally a vertically oriented rectangular shape structure which can be constructed of any suitable material such as steel or other structural material capable of securing weight stack guide rods 92 and supporting weight stack 93. Weight stack guide rods 92 are generally elongated tubes or rods which control the path of weight stack 93 during operation of machine 10. Weight stack 93 consist of individual stacked weight plates that each generally have two spaced holes for receiving weight stack guide rods 92.

Referring now to FIGS. 1-4, which represent an embodiment of the invention that exercises user U's abdominal muscles, user engagement member 50 is mounted on user support frame 31 via pivot axle 15C. User engagement member 50 is a pivoting head and shoulder support assembly with attached grip handles 51 for receiving the user U's hands. User support pads 32 consist of user support pad 32A for supporting user U's legs, user support pad 32B for supporting user U's hips and torso, and user support pads 32C for supporting user U's head and shoulders. User engagement member 50 is operatively linked to lifting member 70 via pivoting linkage lever 71, pivoting linkage lever wheel 72, linkage cable anchors 62, linkage cable 61, and linkage cable pulley 60. A first lower end of lifting member 70 is pivotably mounted on main frame 20 and a second upper end of lifting member 70 is pivotably connected to user support 30. An upper portion of user support 30 is pivotally connected to lifting member 70 and a lower portion of user support 30 is pivotally connected to traveling member assembly 40. Traveling member assembly 40 is rollably engaged with slide surface 25. Although not illustrated so as to more clearly present some components of this embodiment, this embodiment of the invention can be configured to add additional resistance to the exercise motion of machine 10 wherein weight disc receivers 75 could be rigidly attached to lifting member 70 for receiving removable weight discs 80, or weight stack assembly 90 could be operatively linked to the exercise motion of machine 10 or both resistance features could be added to machine 10.

To operate this embodiment of the invention, the user U enters machine 10 and assumes a generally modified supine position in which support pads 32A supports the back of user U's legs that are positioned at a proximal 90 degree angle with the user U's thighs generally perpendicular to the user U's torso. User U's hips and the back of user U's torso are supported by user support pad 32B and the back of the user U's head and shoulders are supported by user support pad 32C. To activate and engage machine 10, user U grasp grip handles 51, which are rigidly attached to user engagement member 50, and urges them upward in an arcing motion, thus pivoting user engagement member 50 about pivot axle 15C mounted on user support frame 31. This motion acts upon linkage cable 61 which is guided by linkage cable pulley 60 and attached at a first end to user engagement member 50 with a linkage cable anchor 62 and attached at a second end to pivoting linkage lever 71 with a linkage cable anchor 62. Concurrently as user U urges user engagement member 50 into an upward arcing motion, linkage cable 61 acts upon pivoting linkage lever 71 causing it to move upward in an arcing motion about pivot bearing 16B, causing pivoting linkage lever wheel 72 to rollably engage lifting member 70 causing it to move upward in an arcing motion about pivot bearing 16A. This motion concurrently causes traveling member assembly 40 to roll along slide surfaces 25 in a direction towards lifting member 70, thus causing lifting member 70 to pivot about pivot bearing 16A and causing the pivotable connection 15B of lifting member 70 and user support 30 to move upward and user support 30 to roll in a direction towards a rearward portion of machine 10 while pivoting on traveling member assembly 40 about pivot axle 15A. This concurrent rolling and rotating motion of user support 30 that occurs when the urging force upon user engagement member 50 is increased causes user U's center of mass to move dynamically relative to the user U's hands such that User U moves from a generally supine orientation in the at rest and unactivated position to a more reclined seated position as user U approaches the fully activated and engaged position. User U can maintain the position of user support 30 at any location between the at rest position and the fully activated position during the exercise motion.

At any time during the exercise motion when user U decreases the urging force upon grip handles 51 and user engagement member 50, user engagement actuator 50 will move in a downward arcing motion, thus pivoting user engagement member 50 about pivot axle 15C concurrently causing linkage cable 61 to decrease the force acting upon pivoting lever arm 71 and pivoting lever arm wheel 72 such that the force acting upon lifting member 70 is decreased causing traveling member assembly 40 to roll on slide surfaces 25 away from lifting member 70, thus causing lifting member 70 to pivot about pivot bearing 16A and causing the pivotable connection 15B of lifting member 70 and user support 30 to move downward and user support 30 to roll in a direction towards the forward portion of machine 10 while pivoting on traveling member assembly 40 about pivot axle 15A. This concurrent rolling and rotating motion of user support 30 that occurs when the urging force upon user engagement member 50 is reduced causes user U's center of mass to move dynamically relative to the user U's hands such that user U moves from a more reclined seated position in the more activated and engaged position to a generally supine orientation as user U approaches the at rest and unactivated position.

User U can perform multiple repetitions of urging and releasing the force required to operate this embodiment of the machine 10 so as to perform a set of abdominal muscle exercises. The dynamic motion of the user support 30 in this embodiment creates a greater range of motion that more closely assimilates a natural crunching motion of the user U's abdominal muscles thus creating an improved and more effective way to exercise the user U's abdominal muscles.

Referring now to FIGS. 5-8, which represent an embodiment of the invention with removable weight discs resistance that exercises user U's hamstring muscles, user engagement member 50 is mounted on user support frame 31 via pivot bearing 16B. User engagement member 50 is a pivoting lever with attached leg pads 38 for receiving the back of the user U's ankles. User support pad 32 supports user U's thighs and torso. Grip handles 51 are rigidly connected to user support frame 31 and provide a hand grip to user U for bracing and stabilizing user U during operation of machine 10. User engagement member 50 is operatively linked to traveling member assembly 40 via linkage cable 61 and linkage cable pulleys 60. A first lower end of lifting member 70 is pivotably mounted on main frame 20 and a second upper end of lifting member 70 is pivotably connected to user support 30. An upper portion of user support 30 is pivotally connected to lifting member 70 and a lower portion of user support 30 is pivotally connected to traveling member assembly 40. Traveling member assembly 40 is rollably engaged with slide surfaces 25. Weight disc receivers 75 are rigidly mounted on lifting member 70 and removable weight discs 80 are loaded onto weight receivers 75 for adding additional resistance to the exercise motion of machine 10. Although not illustrated, machine 10 may alternatively be operatively linked to weight stack assembly 90 for adding additional resistance to exercise motion of machine 10.

To operate this embodiment of the invention, user U enters machine 10 and assumes a prone position such that the front of user U's torso and thighs are supported by user support pad 32 with user U's lower legs extended away from and are not supported by user support pad 32. User U places his or her ankles below leg pads 38 so that leg pads 38 can be engaged by the back of user U's ankles. User U may grasp grip handles 51 for bracing and stabilizing user U. To activate and engage machine 10, user U urges leg pads 38, which are attached to user engagement member 50, in an upward arcing motion thus pivoting user engagement member 50 about pivot bearing 16B mounted on user support frame 31. This motion acts upon linkage cable 61, which is guided by linkage cable pulleys 60 and attached at a first end to user engagement member 50 with a linkage cable anchor 62 and attached at a second end to traveling member assembly 40 with a linkage cable anchor 62. Concurrently as user U urges user engagement member 50 into an upward arcing motion, linkage cable 61 acts upon traveling member assembly 40. This motion concurrently causes traveling member assembly 40 to roll along slide surfaces 25 in a direction towards lifting member 70, thus causing lifting member 70 to pivot about pivot bearing 16A and causing the pivotable connection 15B of lifting member 70 and user support 30 to move upward and user support 30 to roll in a direction towards the rearward portion of machine 10 while pivoting on traveling member assembly 40 about pivot axle 15A. This concurrent rolling and rotating motion of user support 30 that occurs when the urging force upon user engagement member 50 is increased causes user U's center of mass to move dynamically relative to the user U's feet such that user U moves from a generally prone orientation wherein user U's shoulders and knees are at a similar distance from the floor in the at rest and unactivated position to a more incline position wherein user U's shoulders are at a substantially higher distance from the floor than user U's knees as user U approaches the fully activated and engaged position. User U can maintain the position of user support 30 at any location between the at rest position and the fully activated position during the exercise motion.

At any time during the exercise motion when user U decreases the urging force upon leg pads 38 and user engagement member 50, user engagement member 50 will move in a downward arcing motion thus pivoting user engagement member 50 about pivot bearing 16B concurrently causing linkage cable 61 to decrease the pulling force acting upon traveling member assembly 40 causing traveling member assembly 40 to roll on slide surface 25 away from lifting member 70, thus causing lifting member 70 to pivot about pivot bearing 16A and causing the pivotable connection 15B of lifting member 70 and user support 30 to move downward and user support 30 to roll in a direction away from the rearward portion of machine 10 while pivoting on traveling member assembly 40 about pivot axle 15A. This concurrent rolling and rotating motion of user support 30 that occurs when the urging force upon user engagement member 50 is reduced causes user U's center of mass to move dynamically relative to the user U's feet such that user U moves from a more inclined position wherein user U's shoulders are at a substantially higher distance from the floor than user U's knees in the more engaged and activated position to a generally prone orientation wherein user U's shoulders and knees are at a similar distance from the floor as user U approaches the at rest and unactivated position.

User U can perform multiple repetitions of urging and releasing the force required to operate this embodiment of the machine 10 so as to perform a set of hamstring muscle exercises. The dynamic motion of the user support 30 in this embodiment positions the user U's torso at an elevated angled in the activated and engaged position reducing stress on the user U's lower back and better positioning the user U to fully activate his or her hamstring muscles. This decreases the risk of injury to the user U and allows for greater activation of the user U's hamstring muscles thus creating an improved way to exercise the user U's hamstring muscles.

Referring now to FIGS. 9-12, which represent an embodiment of the invention with removable weight discs resistance that exercises the user U's quadriceps muscles, user engagement member 50 is mounted on the user support frame 31 via pivot bearing 16B. User engagement member 50 is a pivoting lever with attached leg pads 38 for receiving the front of the user U's ankles. User support pad 32A supports user U's hips and thighs and user support pad 32B supports user U's torso. Grip handles 51 are rigidly connected to user support frame 31 and provide a hand grip to user U for bracing and stabilizing user U during operation of machine 10. User engagement member 50 is operatively linked to traveling member assembly 40 via linkage cable 61 and linkage cable pulleys 60. A first lower end of lifting member 70 is pivotably mounted on main frame 20 and a second upper end of lifting member 70 is pivotably connected to user support 30. An upper portion of user support 30 is pivotally connected to lifting member 70 and a lower portion of user support 30 is pivotally connected to traveling member assembly 40. Traveling member assembly 40 is rollably engaged with slide surfaces 25. Weight disc receiver 75 is rigidly mounted on lifting member 70 and removable weight discs 80 are loaded onto weight receivers 75 for adding additional resistance to the exercise motion of machine 10. Although not illustrated, machine 10 may alternatively be operatively linked to weight stack assembly 90 for adding additional resistance to exercise motion of machine 10.

To operate this embodiment of the invention, user U enters machine 10 and assumes a reclined seated position such that the back of user U's thighs and hips are supported by user support pad 32A and back of user U's torso is supported by user support pad 32B with user U's lower legs extended downward from and are not supported by user support pad 32A. User U places his or her ankles between user support pad 32A and leg pads 38 so that leg pads 38 can be engaged by the front of user U's ankles. User U may grasp grip handles 51 for bracing and stabilizing user U. To activate and engage machine 10, user U urges leg pads 38, which are attached to user engagement member 50, in an upward arcing motion, thus pivoting user engagement member 50 about pivot bearing 16B mounted on user support frame 31. This motion acts upon linkage cable 61, which is guided by linkage cable pulleys 60 and attached at a first end to user engagement member 50 with a linkage cable anchor 62 and attached at a second end to traveling member assembly 40 with a linkage cable anchor 62. Concurrently as user U urges user engagement member 50 into an upward arcing motion, linkage cable 61 acts upon traveling member assembly 40. This motion concurrently causes traveling member assembly 40 to roll along slide surfaces 25 in a direction towards lifting member 70, thus causing lifting member 70 to pivot about pivot bearing 16A and causing the pivotable connection 15B of lifting member 70 and user support 30 to move upward and user support 30 to roll in a direction towards the rearward portion of machine 10 while pivoting on traveling member assembly 40 about pivot axle 15A. This concurrent rolling and rotating motion of user support 30 that occurs when the urging force upon user engagement member 50 is increased causes user U's center of mass to move dynamically relative to the user U's feet such that user U moves from a generally reclined seated orientation wherein user U's hips are substantially closer to the floor than user U's knees in the at rest and unactivated position to a more flat seated position wherein user U's hips and knees are approximately the same distance from the floor as user U approaches the fully activated and engaged position. User U can maintain the position of user support 30 at any location between the at rest position and the fully activated position during the exercise motion.

At any time during the exercise motion when user U decreases the urging force upon leg pads 38 and user engagement member 50, user engagement member 50 will move in a downward arcing motion, thus pivoting user engagement member 50 about pivot bearing 16B concurrently causing linkage cable 61 to decrease the pulling force acting upon traveling member assembly 40 causing traveling member assembly 40 to roll on slide surface 25 away from lifting member 70, thus causing lifting member 70 to pivot about pivot bearing 16A and causing the pivotable connection 15B of lifting member 70 and user support 30 to move downward and user support 30 to roll in a direction away from the rearward portion of machine 10 while pivoting on traveling member assembly 40 about pivot axle 15A. This concurrent rolling and rotating motion of user support 30 that occurs when the urging force upon user engagement member 50 is reduced causes user U's center of mass to move dynamically relative to the user U's feet such that user U moves from a more flat seated position wherein user U's hips and knees are approximately the same distance from the floor to a reclined seated position wherein user U's hips are a substantially closer distance from the floor than user U's knees as user U approaches the at rest and unactivated position.

User U can perform multiple repetitions of urging and releasing the force required to operate this embodiment of the machine 10 so as to perform a set of quadriceps muscle exercises. The dynamic motion of the user support 30 in this embodiment properly positions the user U's center of mass and the angle of the user U's thighs in the at rest and unactivated position to generate power by the user U's quadriceps and reduce stress on the user U's lower back. The activated position of this embodiment also allows the user U to fully activate the quadriceps muscles. This decreases the risk of injury to the user U and allows for greater activation of the user U's quadriceps muscles, thus creating an improved way to exercise the user U's quadriceps muscles.

Referring now to FIGS. 13-16, which represent an embodiment of the invention with removable weight discs resistance that exercises the user U's pectoral muscles, user engagement member 50 is mounted on main frame 20 via pivot bearings 16B. User engagement member 50 is comprised of two pivoting levers rigidly connected by user engagement member cross brace 52 with grip handles 51 attached to each lever for receiving user U's hands. User support pad 32A supports user U's hips and thighs, user support pad 32B supports user U's torso, and user foot support 34 supports user U's feet. User engagement actuator 50 is operatively linked to traveling member assembly 40 via linkage cable 61 and linkage cable pulleys 60. A first lower end of lifting member 70 is pivotably mounted on main frame 20 and a second upper end of lifting member 70 is pivotably connected to user support 30. An upper portion of user support 30 is pivotally connected to lifting member 70 and a lower portion of user support 30 is pivotally connected to traveling member assembly 40. Traveling member assembly 40 is rollably engaged with slide surfaces 25. Weight disc receivers 75 are rigidly mounted on user engagement member 50 and removable weight discs 80 are loaded onto weight receivers 75 for adding additional resistance to the exercise motion of machine 10. Although not illustrated, machine 10 may alternatively be operatively linked to weight stack assembly 90 for adding additional resistance to exercise motion of machine 10.

To operate this embodiment of the invention, user U enters machine 10 and assumes a reclined seated position while grasping grip handles 51. The back of user U's thighs and user U's hips are supported by user support pad 32A and the back of user U's torso is supported by user support pad 32B with user U's feet being supported by user foot support 34. To activate and engage machine 10, user U presses grip handles 51, which are attached to user engagement member 50, away from user U's torso in an upward arcing motion, thus pivoting user engagement member 50 about pivot bearings 16B mounted on main frame 20. This motion acts upon linkage cable 61, which is guided by linkage cable pulleys 60 and attached at a first end to user engagement member cross brace 52 with a linkage cable anchor 62 and attached at a second end to traveling member assembly 40 with a linkage cable anchor 62. Concurrently as user U urges user engagement member 50 into an upward arcing motion, linkage cable 61 acts upon traveling member assembly 40. This motion concurrently causes traveling member assembly 40 to roll along slide surfaces 25 in a direction towards lifting member 70, thus causing lifting member 70 to pivot about pivot bearing 16A and causing the pivotable connection 15B of lifting member 70 and user support 30 to move upward and user support 30 to roll in a direction towards the rearward portion of machine 10 while pivoting on traveling member assembly 40 about pivot axle 15A. This concurrent rolling and rotating motion of user support 30 that occurs when the urging force upon user engagement member 50 is increased causes user U's center of mass to move dynamically relative to the user U's hands such that user U moves from a mostly reclined seated orientation wherein user U's hips are substantially closer to the floor than user U's knees in the at rest and unactivated position to a minimally reclined seated position wherein user U's hips are minimally closer to the floor than user U's knees as user U approaches the fully activated and engaged position. User U can maintain the position of user support 30 at any location between the at rest position and the fully activated position during the exercise motion.

At any time during the exercise motion when user U decreases the urging force upon grip handles 51 and user engagement member 50, user engagement actuator 50 will move in a downward arcing motion thus pivoting user engagement member 50 about pivot bearings 16B concurrently causing linkage cable 61 to decrease the pulling force acting upon traveling member assembly 40 causing traveling member assembly 40 to roll on slide surface 25 away from lifting member 70, thus causing lifting member 70 to pivot about pivot bearing 16A and causing the pivotable connection 15B of lifting member 70 and user support 30 to move downward and user support 30 to roll in a direction away from the rearward portion of machine 10 while pivoting on traveling member assembly 40 about pivot axle 15A. This concurrent rolling and rotating motion of user support 30 that occurs when the urging force upon user engagement member 50 is reduced causes user U's center of mass to move dynamically relative to the user U's hands such that user U moves from a minimally reclined seated position wherein user U's hips are only minimally closer to the floor than user U's knees to a position wherein user U's hips are a substantially closer distance from the floor than user U's knees as user U approaches the at rest and unactivated position.

User U can perform multiple repetitions of urging and releasing the force required to operate this embodiment of the machine 10 so as to perform a set of pectoral muscle exercises. The dynamic motion of the user support 30 in this embodiment properly positions the user U's center of mass to prevent arching of the user U's back during the exercise motion and properly aligns the user U's entire body into an optimal leverage position for generating power from the pectoral muscles. This decreases the risk of injury to the user U and allows for greater activation of the user U's pectoral muscles thus creating an improved way to exercise the user U's pectoral muscles.

Referring now to FIGS. 17-20, which represent an alternative embodiment of the invention with removable weight discs resistance that exercises the user U's pectoral muscles, user engagement member 50 is mounted on main frame 20 via pivot bearings 16B. User engagement member 50 is comprised of two pivoting levers rigidly connected by user engagement member cross brace 52 with grip handles 51 attached to each lever for receiving user U's hands. User support pad 32A supports user U's hips and thighs, user support pad 32B supports user U's torso, and user foot support 34 supports user U's feet. User engagement member 50 is operatively linked to lifting member 70 via link bar 73. Link bar 73 is an elongated member having a first lower pivoting end and a second upper pivoting end. A first lower end of lifting member 70 is pivotably mounted on main frame 20 and a second upper end of lifting member 70 is pivotably connected to user support 30. An upper portion of user support 30 is pivotally connected to lifting member 70 and a lower portion of user support 30 is pivotally connected to traveling member assembly 40. Traveling member assembly 40 is rollably engaged with slide surfaces 25. Weight disc receivers 75 is rigidly mounted on user engagement member 50 and removable weight discs 80 are loaded onto weight receivers 75 for adding additional resistance to the exercise motion of machine 10. Although not illustrated, machine 10 may alternatively be operatively linked to weight stack assembly 90 for adding additional resistance to exercise motion of machine 10.

To operate this embodiment of the invention, user U enters machine 10 and assumes a reclined seated position while grasping grip handles 51. The back of user U's thighs and user U's hips are supported by user support pad 32A and the back of user U's torso is supported by user support pad 32B with user U's feet being supported by user foot support 34. To activate and engage machine 10, user U presses grip handles 51, which are attached to user engagement member 50, away from user U's torso in an upward arcing motion, thus pivoting user engagement member 50 about pivot bearings 16B mounted on main frame 20. This motion acts upon link bar 73, which is pivotally attached at a first upper end to user engagement member cross brace 52 at pivot bearing 16C and attached at a second lower end to lifting member 70 at pivot axle 15C. Concurrently as user U urges user engagement member 50 into an upward arcing motion, link bar 73 acts upon lifting member 70. This motion concurrently causes traveling member assembly 40 to roll along slide surfaces 25 in a direction towards lifting member 70, thus causing lifting member 70 to pivot about pivot bearing 16A and causing the pivotable connection 15B of lifting member 70 and user support 30 to move upward and user support 30 to roll in a direction towards the rearward portion of machine 10 while pivoting on traveling member assembly 40 about pivot axle 15A. This concurrent rolling and rotating motion of user support 30 that occurs when the urging force upon user engagement member 50 is increased causes user U's center of mass to move dynamically relative to the user U's hands such that user U moves from a mostly reclined seated orientation wherein user U's hips are substantially closer to the floor than user U's knees in the at rest and unactivated position to a minimally reclined seated position wherein user U's hips are minimally closer to the floor than user U's knees as user U approaches the fully activated and engaged position. User U can maintain the position of user support 30 at any location between the at rest position and the fully activated position during the exercise motion.

At any time during the exercise motion when user U decreases the urging force upon grip handles 51 and user engagement member 50, user engagement member 50 will move in a downward arcing motion thus pivoting user engagement member 50 about pivot bearings 16B concurrently causing link bar 73 to decrease the lifting force acting upon lifting member 70 causing traveling member assembly 40 to roll on slide surface 25 away from lifting member 70 thus causing lifting member 70 to pivot about pivot bearing 16A and causing the pivotable connection 15B of lifting member 70 and user support 30 to move downward and user support 30 to roll in a direction away from the rearward portion of machine 10 while pivoting on traveling member assembly 40 about pivot axle 15A. This concurrent rolling and rotating motion of user support 30 that occurs when the urging force upon user engagement member 50 is reduced causes user U's center of mass to move dynamically relative to the user U's hands such that user U moves from a minimally reclined seated position wherein user U's hips are only minimally closer to the floor than user U's knees to a position wherein user U's hips are a substantially closer distance from the floor than user U's knees as user U approaches the at rest and unactivated position.

User U can perform multiple repetitions of urging and releasing the force required to operate this embodiment of the machine 10 so as to perform a set of pectoral muscle exercises. The dynamic motion of the user support 30 in this embodiment properly positions the user U's center of mass to prevent arching of the user U's back during the exercise motion and properly aligns the user U's entire body into an optimal leverage position for generating power from the pectoral muscles. This decreases the risk of injury to the user U and allows for greater activation of the user U's pectoral muscles thus creating an improved way to exercise the user U's pectoral muscles.

Referring now to FIGS. 21-24, which represent an embodiment of the invention with removable weight discs resistance that exercises the user U's latissimus dorsi muscles, user engagement member 50 is mounted on main frame 20 via pivot bearings 16B. User engagement member 50 is comprised of two pivoting levers rigidly connected by user engagement member cross brace 52 with grip handles 51 attached to each lever for receiving user U's hands. User support pad 32 supports user U's hips and buttocks and user foot support 34 supports user U's feet. User hold down pad 33 stabilizes user U's thighs. User engagement member 50 is operatively linked to traveling member assembly 40 via linkage cable 61 and linkage cable pulleys 60. A first lower end of lifting member 70 is pivotably mounted on main frame 20 and a second upper end of lifting member 70 is pivotably connected to user support 30. An upper portion of user support 30 is pivotally connected to lifting member 70 and a lower portion of user support 30 is pivotally connected to traveling member assembly 40. Traveling member assembly 40 is rollably engaged with slide surfaces 25. Weight disc receivers 75 are rigidly mounted on lifting member 70 and removable weight discs 80 are loaded onto weight receivers 75 for adding additional resistance to the exercise motion of machine 10.

To operate this embodiment of the invention, user U enters machine 10 and assumes a seated position while grasping grip handles 51. User U's hips and buttocks are supported by user support pad 32 and user foot support 34 supports user U's feet. User hold down pad 33 is positioned on top of user U's thighs to stabilize user U. To activate and engage machine 10, user U pulls grip handles 51, which are attached to user engagement member 50, towards user U's upper torso in a downward arcing motion, thus pivoting user engagement member 50 about pivot bearings 16B mounted on main frame 20. This motion acts upon linkage cable 61, which is guided by linkage cable pulleys 60 and attached at a first end to user engagement actuator cross brace 52 with a linkage cable anchor 62 and attached at a second end to traveling member assembly 40 with a linkage cable anchor 62. Concurrently as user U urges user engagement member 50 into a downward arcing motion, linkage cable 61 acts upon traveling member assembly 40. This motion concurrently causes traveling member assembly 40 to roll along slide surfaces 25 in a direction towards lifting member 70, thus causing lifting member 70 to pivot about pivot bearing 16A and causing the pivotable connection 15B of lifting member 70 and user support 30 to move upward and user support 30 to roll in a direction towards the rearward portion of machine 10 while pivoting on traveling member assembly 40 about pivot axle 15A. This concurrent rolling and rotating motion of user support 30 that occurs when the urging force upon user engagement member 50 is increased causes user U's center of mass to move dynamically relative to the user U's hands such that user U moves from a mostly flat seated position wherein user U's hips and knees are approximately the same distance from the floor in the at rest and unactivated position to a more reclined seated position wherein user U's hips are substantially closer to the floor than user U's knees as user U approaches the fully activated and engaged position. User U can maintain the position of user support 30 at any location between the at rest position and the fully activated position during the exercise motion.

At any time during the exercise motion when user U decreases the urging force upon grip handles 51 and user engagement member 50, user engagement actuator 50 will move in an upward arcing motion, thus pivoting user engagement member 50 about pivot bearings 16B concurrently causing linkage cable 61 to decrease the pulling force acting upon traveling member assembly 40 causing traveling member assembly 40 to roll on slide surface 25 away from lifting member 70, thus causing lifting member 70 to pivot about pivot bearing 16A and causing the pivotable connection 15B of lifting member 70 and user support 30 to move downward and user support 30 to roll in a direction away from the rearward portion of machine 10 while pivoting on traveling member assembly 40 about pivot axle 15A. This concurrent rolling and rotating motion of user support 30 that occurs when the urging force upon user engagement member 50 is reduced causes user U's center of mass to move dynamically relative to the user U's hands such that user U moves from a more reclined seated position wherein user U's hips are substantially closer to the floor than user U's knees to a mostly flat seated position wherein user U's hips and knees are approximately the same distance from the floor as user U approaches the at rest and unactivated position.

User U can perform multiple repetitions of urging and releasing the force required to operate this embodiment of the machine 10 so as to perform a set of latissimus dorsi muscle exercises. The dynamic motion of the user support 30 in this embodiment properly positions the user U's torso throughout the exercise motion for maximum extension and contraction of the user U's latissimus dorsi muscles while also preventing arching of the user U's back during the exercise motion. This decreases the risk of injury to the user U and allows for greater activation of the user U's latissimus dorsi muscles, thus creating an improved way to exercise the user U's latissimus dorsi muscles.

Referring now to FIGS. 26 and 27, which represent an embodiment of the invention with weight stack resistance that exercises the user U's latissimus dorsi muscles, user engagement member 50 is mounted on main frame 20 via pivot bearings 16B. User engagement member 50 is comprised of two pivoting levers rigidly connected by user engagement member cross brace 52 with grip handles 51 attached to each lever for receiving user U's hands. User support pad 32 supports user U's hips and buttocks and user foot support 34 supports user U's feet. User hold down pad 33 stabilizes user U's thighs. User engagement member 50 is operatively linked to traveling member assembly 40 via linkage cable 61A and linkage cable pulleys 60. A first lower end of lifting member 70 is pivotably mounted on main frame 20 and a second upper end of lifting member 70 is pivotably connected to user support 30. An upper portion of user support 30 is pivotally connected to lifting member 70 and a lower portion of user support 30 is pivotally connected to traveling member assembly 40. Traveling member assembly 40 is rollably engaged with slide surfaces 25. Weight stack assembly 90 is operatively linked to lifting member 70 via pivot axle 15C, linkage cable cam 64, linkage cable 61B, and linkage cable pulleys 60.

Figure 21:
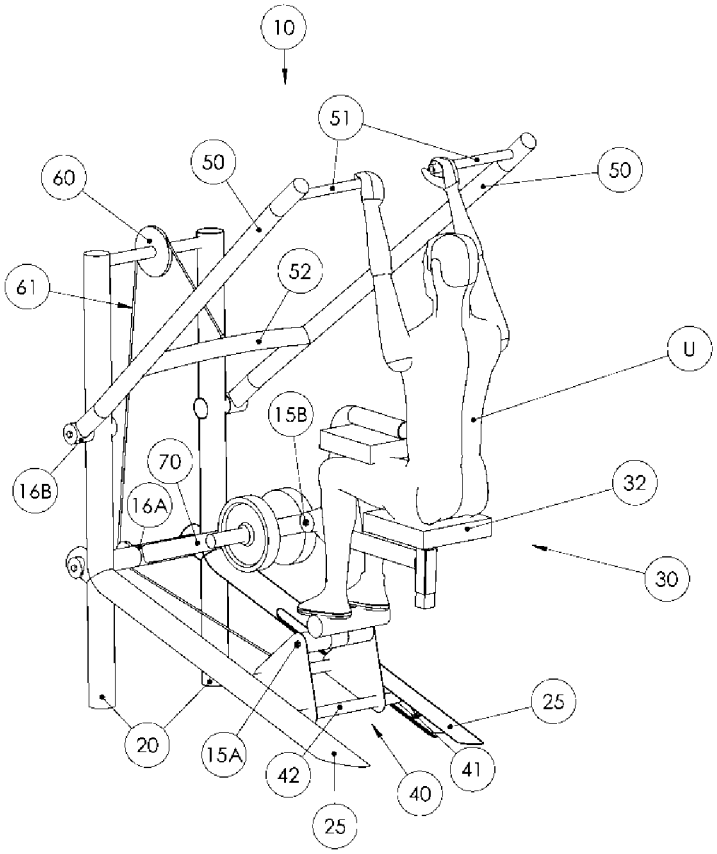
FIG. 21 is a perspective view of an embodiment of the invention in the at rest and unactivated position illustrating a user mounted on a machine that exercises a user's latissimus dorsi muscles wherein the operative linkage connecting the user engagement member and the traveling member is configured as a combination of a cable and a plurality of pulleys. Additional resistance to the exercise motion is provided by removable weight discs that are loaded onto receivers mounted on the lifting member.
Figure 22:
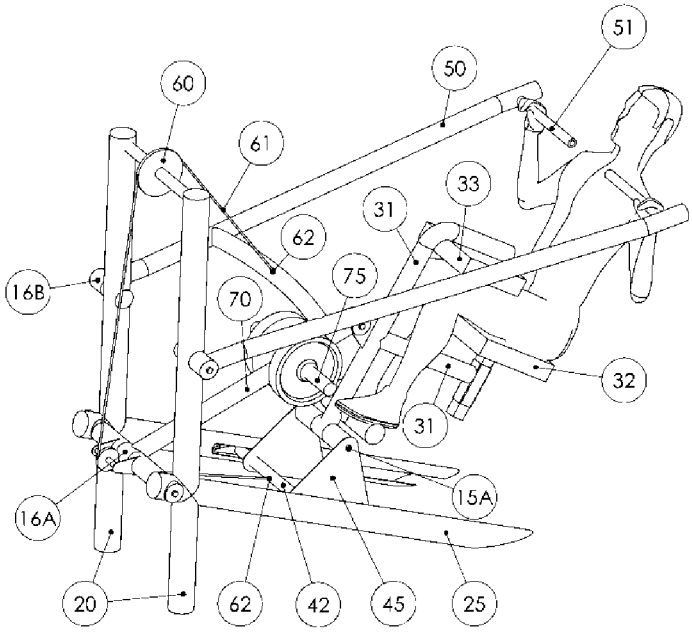
FIG. 22 is a perspective view of an embodiment of the invention in the engaged and activated position illustrating a user mounted on a machine that exercises a user's latissimus dorsi muscles wherein the operative linkage connecting the user engagement member and the traveling member is configured as a combination of a cable and a plurality of pulleys. Additional resistance to the exercise motion is provided by removable weight discs that are loaded onto receivers mounted on the lifting member.
Figure 23:
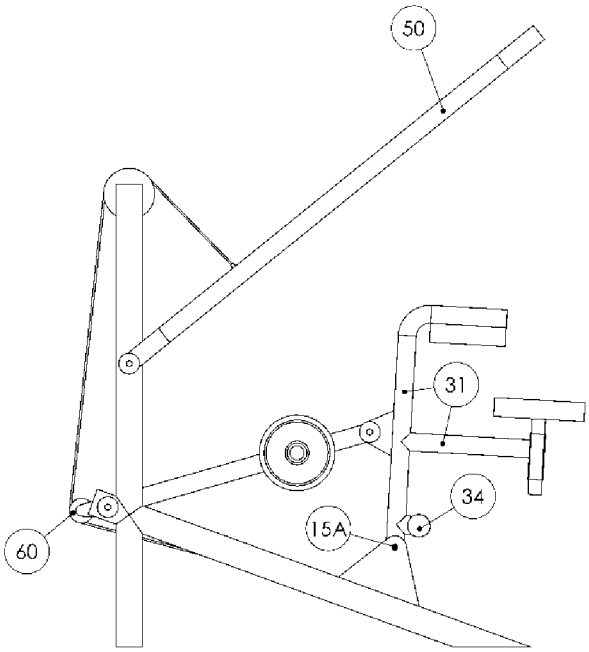
FIG. 23 is a side view of an embodiment of the invention in the at rest and unactivated position illustrating a machine that exercises a user's latissimus dorsi muscles wherein the operative linkage connecting the user engagement member and the traveling member is configured as a combination of a cable and a plurality of pulleys. Additional resistance to the exercise motion is provided by removable weight discs that are loaded onto receivers mounted on the lifting member.
Figure 24:
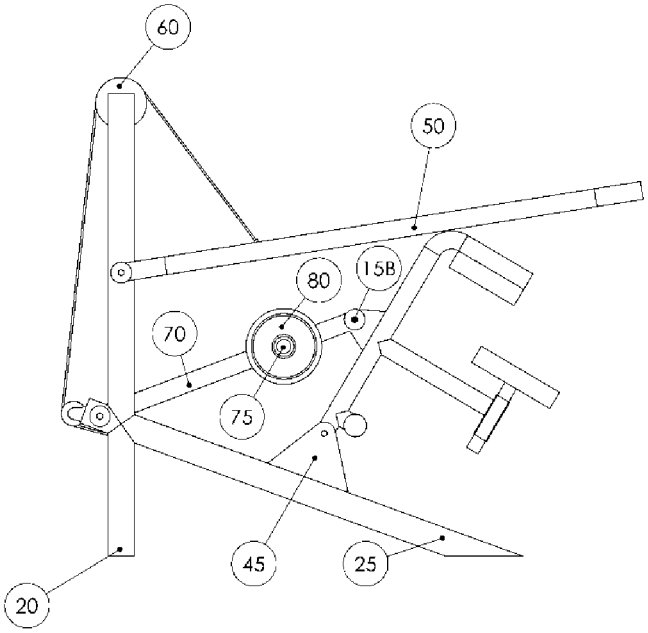
FIG. 24 is a side view of an embodiment of the invention in the engaged and activated position illustrating a machine that exercises a user's latissimus dorsi muscles wherein the operative linkage connecting the user engagement member and the traveling member is configured as a combination of a cable and a plurality of pulleys. Additional resistance to the exercise motion is provided by removable weight discs that are loaded onto receivers mounted on the lifting member.
Figure 25:
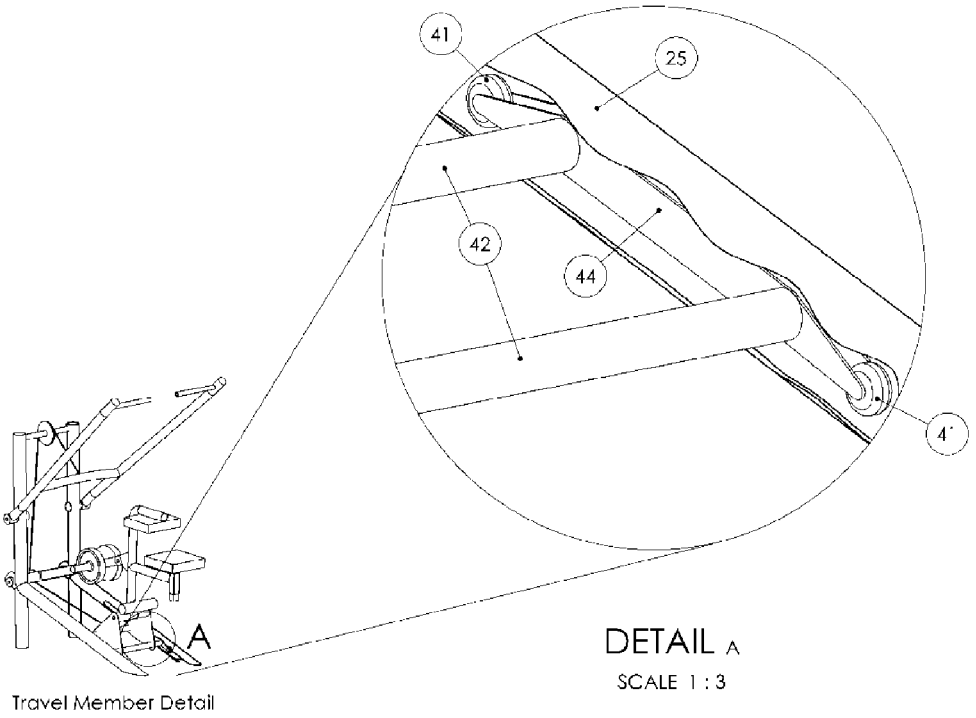
FIG. 25 is a cut away detail view of one side section of the carriage assembly of the traveling member.

This embodiment of the invention as represented in FIGS. 26 and 27 that utilizes a weight stack resistance has an identical exercise motion to the embodiment of the invention represented in FIGS. 21 and 22 that utilizes weight discs resistance such that to operate the embodiment represented in FIGS. 26 and 27 user U would enter machine 10 and assume a seated position while grasping grip handles 51. User U's hips and buttocks would be supported by user support pad 32 and user foot support 34 would support user U's feet. User hold down pad 33 would be positioned on top of user U's thighs to stabilize user U. To activate and engage machine 10, user U would pull grip handles 51 which are attached to user engagement member 50 towards user U's upper torso in a downward arcing motion, thus pivoting user engagement actuator 50 about pivot bearings 16B mounted on main frame 20. This motion would concurrently act upon linkage cable 61A and pivot axle 15C. Linkage cable 61A is guided by linkage cable pulleys 60 and attached at a first end to user engagement member cross brace 52 with a linkage cable anchor 62 and attached at a second end to traveling member assembly 40 with a linkage cable anchor 62. Linkage cable 61A would act upon traveling member assembly 40 causing traveling member assembly 40 to roll along slide surfaces 25 in a direction towards lifting member 70, thus causing lifting member 70 to pivot about pivot bearing 16A and causing the pivotable connection 15B of lifting member 70 and user support 30 to move upward and user support 30 to roll in a direction towards the rearward portion of machine 10 while pivoting on traveling member assembly 40 about pivot axle 15A. The downward arcing motion of user engagement member 50 would also cause pivot axle 15C to rotate and thus rotate linkage cable cam 64, which is rigidly attached to pivot axle 15C, thus cable cam 64 would act upon linkage cable 61B, which would act upon weight stack 93 causing at least a portion of weight stack 93 to lift, thus imparting additional resistance to the exercise motion of machine 10. The concurrent rolling and rotating motion of user support 30 that occurs when the urging force upon user engagement member 50 is increased causes user U's center of mass to move dynamically relative to the user U's hands such that user U moves from a mostly flat seated position wherein user U's hips and knees are approximately the same distance from the floor in the at rest and unactivated position to a more reclined seated position wherein user U's hips are substantially closer to the floor than user U's knees as user U approaches the fully activated and engaged position. User U can maintain the position of user support 30 at any location between the at rest position and the fully activated position during the exercise motion.

At any time during the exercise motion when user U decreases the urging force upon grip handles 51 and user engagement member 50, user engagement member 50 will move in an upward arcing motion, thus pivoting user engagement actuator 50 about pivot bearings 16B concurrently causing linkage cable 61A to decrease the pulling force acting upon traveling member assembly 40 and causing pivot axle 15C to decrease the rotating force on linkage cable cam 64. As the pulling force is reduced on traveling member assembly 40, traveling member assembly 40 will roll on slide surface 25 away from lifting member 70 thus causing lifting member 70 to pivot about pivot bearing 16A and causing the pivotable connection 15B of lifting member 70 and user support 30 to move downward and user support 30 to roll in a direction away from the rearward portion of machine 10 while pivoting on traveling member assembly 40 about pivot axle 15A. As the rotating force is reduced on pivot axle 15C and cable cam 64 the pulley force will be reduced on linkage cable 61B causing at least a portion of weight stack 93 to move downward. The concurrent rolling and rotating motion of user support 30 that occurs when the urging force upon user engagement member 50 is reduced causes user U's center of mass to move dynamically relative to the user U's hands such that user U moves from a more reclined seated position wherein user U's hips are substantially closer to the floor than user U's knees to a mostly flat seated position wherein user U's hips and knees are approximately the same distance from the floor as user U approaches the at rest and unactivated position.

User U can perform multiple repetitions of urging and releasing the force required to operate this embodiment of the machine 10 so as to perform a set of latissimus dorsi muscle exercises. The dynamic motion of the user support 30 in this embodiment properly positions the user U's torso throughout the exercise motion for maximum extension and contraction of the user U's latissimus dorsi muscles while also preventing arching of the user U's back during the exercise motion. This decreases the risk of injury to the user U and allows for greater activation of the user U's latissimus dorsi muscles, thus creating an improved way to exercise the user U's latissimus dorsi muscles.

Referring now to FIGS. 28 and 29, which represent an embodiment of the invention that allows the user U to exercise various upper body muscle groups, user engagement members 50 consist of two individual brackets that each house an attached grip handle 51 for receiving user U's hands. User engagement member 50 is connected directly to individual ends of linkage cable 61. User support pad 32A supports user U's hips and thighs, user support pad 32B supports user U's torso, and user foot support 34 supports user U's feet. User engagement members 50 are operatively linked to traveling member assembly 40 via linkage cable 61 and linkage cable pulleys 60. A first lower end of lifting member 70 is pivotably mounted on main frame 20 and a second upper end of lifting member 70 is pivotably connected to user support 30. An upper portion of user support 30 is pivotally connected to lifting member 70 and a lower portion of user support 30 is pivotally connected to traveling member assembly 40. Traveling member assembly 40 is rollably engaged with slide surfaces 25. Although not illustrated so as to more clearly present some components of this embodiment, this embodiment of the invention can be configured to add additional resistance to the exercise motion of machine 10 wherein weight disc receivers 75 could be rigidly attached to lifting member 70 for receiving removable weight discs 80, or weight stack assembly 90 could be operatively linked to the exercise motion of machine 10 or both resistance features could be added to machine 10.

To operate this embodiment of the invention, user U enters machine 10 and assumes a reclined seated position while grasping grip handles 51. The back of user U's thighs and user U's hips are supported by user support pad 32A and the back of user U's torso is supported by user support pad 32B with user U's feet being supported by user foot support 34. To activate and engage machine 10, user U presses grip handles 51, which are attached to user engagement members 50, away from user U's torso in any direction that user U chooses. This motion acts upon linkage cable 61, which is guided by linkage cable pulleys 60 and attached at a first end to a first user engagement member 50 and attached at a second end to a second user engagement member 50 and a central portion of linkage cable 61 is connected to traveling member cross brace 42 via a linkage cable pulley 60. Concurrently as user U urges user engagement members 50 away from upper linkage cable pulleys 60, linkage cable 61 acts upon traveling member assembly 40. This motion concurrently causes traveling member assembly 40 to roll along slide surfaces 25 in a direction towards lifting member 70, thus causing lifting member 70 to pivot about pivot bearing 16A and causing the pivotable connection 15B of lifting member 70 and user support 30 to move upward and user support 30 to roll in a direction towards the rearward portion of machine 10 while pivoting on traveling member assembly 40 about pivot axle 15A. This concurrent rolling and rotating motion of user support 30 that occurs when the urging force upon user engagement members 50 is increased causes user U's center of mass to move dynamically relative to the user U's hands such that user U moves from a mostly reclined seated position wherein user U's hips are substantially closer to the floor than user U's knees in the at rest and unactivated position to a minimally reclined seated position wherein user U's hips are minimally closer to the floor than user U's knees as user U approaches the fully activated and engaged position. User U can maintain the position of user support 30 at any location between the at rest position and the fully activated position during the exercise motion.

At any time during the exercise motion when user U decreases the urging force upon grip handles 51 and user engagement members 50, user engagement members 50 will move in direction towards upper linkage cable pulleys 60, thus causing linkage cable 61 to decrease the pulling force acting upon traveling member assembly 40 causing traveling member assembly 40 to roll on slide surface 25 away from lifting member 70, thus causing lifting member 70 to pivot about pivot bearing 16A and causing the pivotable connection 15B of lifting member 70 and user support 30 to move downward and user support 30 to roll in a direction away from the rearward portion of machine 10 while pivoting on traveling member assembly 40 about pivot axle 15A. This concurrent rolling and rotating motion of user support 30 that occurs when the urging force upon user engagement members 50 is reduced causes user U's center of mass to move dynamically relative to the user U's hands such that user U moves from a minimally reclined seated position wherein user U's hips are only minimally closer to the floor than user U's knees to a position wherein user U's hips are a substantially closer distance from the floor than user U's knees as user U approaches the at rest and unactivated position.

User U can perform multiple repetitions of urging and releasing the force required to operate this embodiment of the machine 10 so as to perform a set of exercises for the upper body muscle group of the user U's choice. The dynamic motion of the user support 30 in this embodiment properly positions the user U throughout the exercise motion for maximum support and power generation of all upper body pushing motions. This decreases the risk of injury to the user U and allows for greater activation of the user U's upper body muscle groups thus creating an improved way to exercise the user U's upper body muscle groups.

Features and components of the preferred embodiments of the present invention include a slidable and rotatable user support 30 that cooperates with at least one movable user engagement member 50 for exercising in dynamic motion, the machine 10 comprising: (a) a stationary main frame 20 having a forward end and a rearward end that supports machine 10; (b) two stationary slide surfaces 25 connected to or part of the main frame 20; (c) a traveling member assembly 40 slidably engaged with slide surfaces 25; (d) a lifting member 70 that is pivotally mounted on main frame 20 and pivotally connected to user support 30; (e) a user support 30 that is pivotably mounted on traveling member assembly 40 and pivotally connected to lifting member 70; (f) a user engagement member 50 with at least one attached receiver for receiving a user's hands or lower legs or torso; and (g) an operative linkage which consists of one or more components that operatively links the concurrent motion of the user engagement member 50 to the user support 30.

In every preferred embodiment, the user support 30 and the user engagement member 50 are movable between a first at rest and unactivated position and a second engaged and fully activated position, and can be maintained at any position between the first at rest and unactivated position and the second engaged and fully activated position.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

REFERENCE NUMERALS

No. Description
U User
10 Machine
15 Pivot axle
16 Pivot bearing
20 Stationary main frame
25 Slide surface
30 User support assembly
31 User support frame
32 User support pad
33 User hold down pad
34 User foot support
38 Leg pads
40 Traveling member assembly
41 Traveling member wheel
42 Traveling member frame cross brace
44 Traveling member wheel connection bracket
45 Traveling member frame
50 User engagement member
51 Grip handle
52 User engagement member cross brace
60 Linkage cable pulley
61 Linkage cable
62 Linkage cable anchor
64 Linkage cable cam
70 Lifting member
71 Pivoting linkage lever
72 Pivoting linkage lever wheel
73 Linkage bar
75 Weight disc receiver
80 Removable weight disc
90 Weight stack assembly
91 Weight stack frame
92 Weight stack guide rods
93 Weight stack

What is claimed is:

1. A dynamic motion exercise machine comprising:

(a) a stationary main frame having a forward end and a rearward end;

(b) two parallel stationary slide support surfaces connected to or part of the main frame;

(c) a traveling member engaging the slide support surfaces for movement in a fixed path along the slide support surfaces, wherein the slide support surfaces support the traveling member;

(d) a movable user support having a first pivotal connection and a second pivotal connection;

(e) an elongated rigid lifting member having a first end and a second end, wherein the first end of the lifting member is pivotally connected to the main frame and the second end of the lifting member is pivotally connected to the second pivotal connection of the user support, whereby the second end of the lifting member and the second pivotal connection of the user support intersect at an intersecting pivotal location that is located above a line or plane extending between the first end of the lifting member and the first pivotal connection of the user support, and whereby the intersecting pivotal location remains above the line or plane that extends between the first end of the lifting member and the first pivotal connection of the user support during operation of the machine;

(f) a movable user engagement member mounted on the user support or main frame and operatively linked to the traveling member and or the lifting member, wherein movement of the user engagement member concurrently moves the traveling member, the lifting member, and the user support; and (g) an operative linkage connecting the user engagement member to the traveling member and or to the lifting member, wherein the first pivotal connection of the user support is connected to the traveling member at a first elevation relative to the main frame, wherein the second pivotal connection of the user support is connected to the lifting member at a second elevation relative to the main frame that is higher than the first elevation, and wherein the second pivotal connection of the user support remains at a higher elevation relative to the main frame than the first pivotal connection of the user support relative to the main frame during operation of the machine.

2. The dynamic motion exercise machine of claim 1, wherein the lifting member controls an angular orientation of the user support relative to the main frame during operation of the machine and the lifting member locates the traveling member as the traveling member travels along the slide support surfaces during operation of the machine.

3. The dynamic motion exercise machine of claim 2, wherein the operative linkage comprises at least one flexible component and at least one guide component.

4. The dynamic motion exercise machine of claim 2, wherein the operative linkage comprises at least one rigid component.

5. The dynamic motion exercise machine of claim 2, wherein the operative linkage comprises a combination of at least one flexible component, at least one guide component, and at least one rigid component.

6. The dynamic motion exercise machine of claim 2, wherein the operative linkage comprises a combination of at least one flexible component, at least one guide component, at least one rigid component, and at least one slide component.

7. The dynamic motion exercise machine of claim 2, wherein the user engagement member is a single member.

8. The dynamic motion exercise machine of claim 2, wherein the user engagement member comprises two independent converging and diverging members for movement only by a user's hands or for movement only by the user's feet.

9. The dynamic motion exercise machine of claim 2, wherein a distance between the user engagement member and at least a portion of the user support is adjustable when the machine is in the at rest and unactivated position and an angle of the user engagement member relative to at least a portion of the user support is adjustable when the machine is in the at rest and unactivated position.

10. The dynamic motion exercise machine of claim 2, wherein the user engagement member has a first at rest and unactivated position and a second engaged and fully activated position and the user engagement member can be maintained anywhere in between the first at rest and unactivated position and the second engaged and fully activated position during operation of the machine.

11. The dynamic motion exercise machine of claim 2, wherein engagement and activation of the user engagement member causes the user support to concurrently slide and rotate.

12. The dynamic motion exercise machine of claim 10, wherein additional resistance can be added to operation of the machine so as to increase a force required to move the user engagement member, the traveling member, and the user support from the first at rest and unactivated position to the second engaged and fully activated position and all points in between the first at rest and unactivated position and the second engaged and fully activated position.

13. The dynamic motion exercise machine of claim 12, wherein the additional resistance comprises at least one component selected from the group consisting of removable free weights, weight stacks, hydraulics, pneumatics, springs, flexible rods, electronic brakes, mechanical brakes, and moment arms.

14. The dynamic motion exercise machine of claim 12, wherein the additional resistance is variable from the first at rest and unactivated position to the second engaged and fully activated position.

15. The dynamic motion exercise machine of claim 12, wherein the amount of additional resistance can be adjusted during operation of the machine.

16. A dynamic motion exercise machine comprising:

(a) a stationary main frame having a forward end and a rearward end;

(b) two parallel stationary slide support surfaces connected to or part of the main frame;

(c) a traveling member engaging the slide support surfaces for movement in a fixed path along the slide support surfaces, wherein the slide support surfaces support the traveling member;

(d) a movable user support having a first pivotal connection and a second pivotal connection;

(e) an elongated rigid lifting member having a first end and a second end, wherein the first end of the lifting member is pivotally connected to the main frame and the second end of the lifting member is pivotally connected to the second pivotal connection of the user support, whereby the second end of the lifting member and the second pivotal connection of the user support intersect at a first intersecting pivotal location that is located above a line or plane extending between the first end of the lifting member and the first pivotal connection of the user support, and whereby the intersecting pivotal location remains above the line or plane that extends between the first end of the lifting member and the first pivotal connection of the user support during operation of the machine;

(f) two independent movable user engagement members each of which is connected to a flexible linkage component and each of which is operatively linked to the traveling member and or to the lifting member; and (g) an operative linkage connecting the user engagement members to the traveling member and or to the lifting member, wherein the first pivotal connection of the user support is connected to the traveling member at a first elevation relative to the main frame, wherein the second pivotal connection of the user support is connected to the lifting member at a second elevation relative to the main frame that is higher than the first elevation, and wherein the second pivotal connection of the user support remains at a higher elevation relative to the main frame than the first pivotal connection of the user support relative to the main frame during operation of the machine.

17. The dynamic motion exercise machine of claim 16, wherein the lifting member controls an angular orientation of the user support relative to the main frame during operation of the machine and the lifting member locates the traveling member as the traveling member travels along the slide support surfaces during operation of the machine.

18. The dynamic motion exercise machine of claim 17, wherein the operative linkage connects the user engagement members to the traveling member and or to the lifting member.

19. The dynamic motion exercise machine of claim 17, wherein the operative linkage comprises at least one flexible component and at least one guide component.

20. The dynamic motion exercise machine of claim 17, wherein the operative linkage comprises a combination of at least one flexible component, at least one guide component, and at least one rigid component.

21. The dynamic motion exercise machine of claim 17, wherein the operative linkage comprises a combination of at least one flexible component, at least one guide component, at least one rigid component, and at least one slide component.

22. The dynamic motion exercise machine of claim 17, wherein the user engagement members comprise two independent brackets with connected handles for receiving a user's hands, wherein the user can determine the path of motion of the handles during operation of the machine.

23. The dynamic motion exercise machine of claim 17, wherein a distance between the user engagement members and at least a portion of the user support is adjustable when the machine is in the at rest and unactivated position.

24. The dynamic motion exercise machine of claim 17, wherein the user engagement members each have a first at rest and unactivated position and a second engaged and fully activated position and the user engagement members can be maintained anywhere in between the first at rest and unactivated position and the second engaged and fully activated position during operation of the machine.

25. The dynamic motion exercise machine of claim 17, wherein engagement and activation of the user engagement members causes the user support to concurrently slide and rotate.

26. The dynamic motion exercise machine of claim 24, wherein additional resistance can be added to operation of the machine so as to increase a force required to move the user engagement members, the traveling member, and the user support from the first at rest and unactivated position to the second engaged and fully activated position and all points in between the first at rest and unactivated position and second engaged and fully activated position.

27. The dynamic motion exercise machine of claim 26, wherein the additional resistance comprises at least one component selected from the group consisting of removable free weights, weight stacks, hydraulics, pneumatics, springs, flexible rods, electronic brakes, mechanical brakes, and moment arms.

28. The dynamic motion exercise machine of claim 26, wherein the additional resistance is variable from the first at rest and unactivated position to the second engaged and fully activated position.

* * * * *